US012799571B2

(12) United States Patent
Endoh et al.

(10) Patent No.: US 12,799,571 B2
(45) **Date of Patent: *Nov. 17, 2026**

(54) HIGH-STRENGTH STEEL SHEET AND METHOD FOR MANUFACTURING THE SAME

(71) Applicant: JFE Steel Corporation, Tokyo (JP)

(72) Inventors: Kazuki Endoh, Tokyo (JP); Yoshiyasu Kawasaki, Tokyo (JP); Yuki Toji, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 470 days.

This patent is subject to a terminal disclaimer.

(21) Appl. No.: 18/274,771

(22) PCT Filed: Nov. 12, 2021

(86) PCT No.: PCT/JP2021/041770

§ 371 (c)(1),
(2) Date: Jul. 28, 2023

(87) PCT Pub. No.: WO2022/172539

PCT Pub. Date: Aug. 18, 2022

(65) Prior Publication Data

US 2024/0167127 A1 May 23, 2024

(30) Foreign Application Priority Data

Feb. 10, 2021 (JP) ..... 2021-019666

(51) Int. Cl.

| | |
|---|---|
| ***C22C 38/04*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/02*** | (2006.01) |
| ***C22C 38/06*** | (2006.01) |
| ***C23C 2/06*** | (2006.01) |
| ***C23C 2/28*** | (2006.01) |

(52) U.S. Cl.

CPC ..... *C22C 38/04* (2013.01); *C21D 6/005* (2013.01); *C21D 8/02* (2013.01); *C21D 8/0226* (2013.01); *C21D 8/0236* (2013.01); *C21D 8/0273* (2013.01); *C22C 38/02* (2013.01); *C22C 38/06* (2013.01); *C23C 2/06* (2013.01); *C23C 2/28* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 2211/002; C21D 2211/005; C21D 2211/008; C21D 1/78; C21D 2211/001; C21D 6/005; C21D 8/0205; C21D 9/46; C21D 8/0226; C21D 8/0263; C21D 8/0273; C22C 38/02; C22C 38/04; C22C 38/06; C22C 38/38

See application file for complete search history.

(56) References Cited

U.S. PATENT DOCUMENTS

| | | | | |
|---|---|---|---|---|
| 9,580,779 | B2 | 2/2017 | Kawasaki et al. | |
| 12,006,562 | B2 * | 6/2024 | Yokoyama | C21D 1/185 |
| 12,442,056 | B2 * | 10/2025 | Yang | C21D 9/46 |
| 2017/0218472 | A1 * | 8/2017 | Kawasaki | C21D 8/0226 |
| 2019/0211427 | A1 | 7/2019 | Sano et al. | |
| 2019/0276907 | A1 | 9/2019 | Yamashita et al. | |
| 2019/0368002 | A1 | 12/2019 | Hayashi et al. | |
| 2020/0392610 | A1 | 12/2020 | Tanaka et al. | |
| 2021/0040588 | A1 | 2/2021 | Toda et al. | |
| 2022/0090248 | A1 * | 3/2022 | Yokoyama | C21D 1/185 |
| 2022/0267876 | A1 | 8/2022 | Endoh et al. | |
| 2024/0124964 | A1 * | 4/2024 | Higuchi | C23C 2/04 |
| 2025/0084515 | A1 * | 3/2025 | Morimoto | C21D 9/46 |
| 2025/0271243 | A1 * | 8/2025 | MacGillivray | F42B 1/02 |
| 2025/0290185 | A1 * | 9/2025 | Wang | C22C 38/58 |

FOREIGN PATENT DOCUMENTS

| | | | |
|---|---|---|---|
| CN | 107075643 | A | 8/2017 |
| CN | 109937265 | A | 6/2019 |
| CN | 110291217 | A | 9/2019 |

(Continued)

OTHER PUBLICATIONS

Extended European Search Report issued Dec. 6, 2024, by the European Patent Office in corresponding European Patent Application No. 21925784.7-1103. (37 pages).

International Search Report and Written Opinion for International Application No. PCT/JP2021/041770, dated Feb. 1, 2022, 6 pages.

Office Action (The First Office Action) issued Oct. 18, 2025, by the State Intellectual Property Office of People's Republic of China in corresponding Chinese Patent Application No. 202180093135.5 and an English translation with Concise explanation of relevance of the Office Action. (11 pages).

(Continued)

*Primary Examiner* — Jie Yang

(74) *Attorney, Agent, or Firm* — Buchanan Ingersoll & Rooney PC

(57) ABSTRACT

A high-strength steel sheet is disclosed having a specified chemical composition and a steel microstructure composed of, on an area fraction basis, ferrite: 1% to 40%, fresh martensite: 1% to 20%, bainite and tempered martensite in total: 35% to 90%, and retained austenite: 6% or more, wherein a value obtained by dividing an average Mn content (% by mass) of the retained austenite by an average Mn content (% by mass) of the ferrite is 1.1 or more, and a value obtained by dividing an average C content (% by mass) of retained austenite with an aspect ratio of 2.0 or more by an average C content (% by mass) of the ferrite is 3.0 or more, and a value obtained by dividing a C content of all retained austenite by a C content of a $T_0$ composition is 1.0 or more.

21 Claims, No Drawings

(56) References Cited

FOREIGN PATENT DOCUMENTS

| | | | |
|---|---|---|---|
| EP | 3 214 193 | A1 | 9/2017 |
| EP | 3 543 365 | A1 | 9/2019 |
| EP | 3 584 342 | A1 | 12/2019 |
| EP | 3 998 366 | A1 | 5/2022 |
| JP | 61157625 | A | 7/1986 |
| JP | 01259120 | A | 10/1989 |
| JP | 2003138345 | A | 5/2003 |
| JP | 6123966 | B1 | 5/2017 |
| JP | 2018178248 | A | 11/2018 |
| WO | 2018131722 | A1 | 7/2018 |
| WO | 2019186989 | A1 | 10/2019 |
| WO | 2021/006296 | A1 | 1/2021 |
| WO | 2021079753 | A1 | 4/2021 |

OTHER PUBLICATIONS

Office Action (Request for the Submission of an Opinion) issued Mar. 19, 2025, by the Korean Intellectual Property Office in corresponding Korean Patent Application No. 10-2023-7025972 and an English translation with the Concise Statement of Relevance of Office Action. (12 pages).

Office Action issued by the U.S. Patent and Trademark Office in the U.S. Appl. No. 18/568,407, mailed May 23, 2025, U.S. Patent and Trademark Office, Alexandria, VA. (6 pages).

Office Action issued by the U.S. Patent and Trademark Office in the U.S. Appl. No. 18/546,428, mailed Dec. 12, 2025, U.S. Patent and Trademark Office, Alexandria, VA. (9 pages).

* cited by examiner

HIGH-STRENGTH STEEL SHEET AND METHOD FOR MANUFACTURING THE SAME

CROSS REFERENCE TO RELATED APPLICATIONS

This is the U.S. National Phase application of PCT/JP2021/041770, filed Nov. 12, 2021, which claims priority to Japanese Patent Application No. 2021-019666, filed Feb. 10, 2021, the disclosures of these applications being incorporated herein by reference in their entireties for all purposes.

FIELD OF THE INVENTION

The present invention relates to a high-strength steel sheet with excellent formability suitable as a member to be used in the industrial sectors of automobiles, electricity, and the like and a method for manufacturing the high-strength steel sheet, and particularly provides a high-strength steel sheet with a TS (tensile strength) of 980 MPa or more and with high hole expansion formability and bendability as well as ductility.

BACKGROUND OF THE INVENTION

In recent years, from the viewpoint of global environmental conservation, improvement of fuel efficiency in automobiles has been an important issue. Thus, there is a strong movement under way to strengthen body materials in order to decrease the thicknesses of the body materials and thereby decrease the weight of automobile bodies. On the other hand, reinforcement of a steel sheet causes a decrease in formability. Thus, there is a demand for the development of a material with both high strength and excellent formability.

A high-strength steel sheet utilizing the deformation-induced transformation of retained austenite has been proposed as a steel sheet with high strength and ductility. Such a steel sheet has a microstructure containing retained austenite, and the retained austenite makes it easy to form the steel sheet and is transformed into martensite after forming, thereby strengthen the steel sheet.

For example, Patent Literature 1 proposes a high-strength steel sheet with a tensile strength of 1000 MPa or more, a total elongation (EL) of 30% or more, and very high ductility utilizing the deformation-induced transformation of retained austenite. Such a steel sheet is manufactured by austenitizing a steel sheet containing C, Si, and Mn as base components and then quenching and holding the steel sheet in a bainite transformation temperature range, that is, austempering the steel sheet. Concentrating carbon into austenite by the austempering produces retained austenite. However, the addition of a large amount of C exceeding 0.3% is required to produce a large amount of retained austenite. Steel with a higher C concentration, however, has lower spot weldability, and steel with a C concentration of more than 0.3% particularly has much lower spot weldability. Thus, it is difficult to practically use such a steel sheet for automobiles. Furthermore, Patent Literature 1 principally aims to improve the ductility of a high-strength thin steel sheet and does not consider hole expansion formability.

In Patent Literature 2, a good strength-ductility balance is achieved by heat treatment in a two-phase region of ferrite and austenite using a steel containing 4% to 6% by weight Mn. However, in Patent Literature 2, an improvement in ductility by the concentration of Mn in untransformed austenite has not been studied, and there is room for improvement in workability.

Patent Literature 3 discloses heat treatment of a steel containing 3.0% to 7.0% by mass Mn in a two-phase region of ferrite and austenite. This concentrates Mn in untransformed austenite, forms stable retained austenite, and improves total elongation. Due to a short heat treatment time and a low diffusion coefficient of Mn, however, it is surmised that the concentration of Mn is insufficient to satisfy both hole expansion formability and bendability as well as the elongation.

Patent Literature 4 discloses long heat treatment of a hot-rolled steel sheet in a two-phase region of ferrite and austenite using a steel containing 0.50% to 12.00% by mass Mn. This forms retained austenite containing Mn concentrated in untransformed austenite and having a high aspect ratio and thereby improves uniform elongation. However, no study has been made on improving hole expansion formability or satisfying both bendability and elongation. Austenite is easily decomposed in coating and galvannealing processes, and a required amount of retained austenite is therefore difficult to form.

PATENT LITERATURE

PTL 1: Patent Literature 1: Japanese Unexamined Patent Application Publication No. 61-157625

PTL 2: Japanese Unexamined Patent Application Publication No. 1-259120

PTL 3: Japanese Unexamined Patent Application Publication No. 2003-138345

PTL 4: Japanese Patent No. 6123966

SUMMARY OF THE INVENTION

Aspects of the present invention have been made in view of such situations and aim to provide a high-strength steel sheet with a TS (tensile strength) of 980 MPa or more, with excellent formability, and without a reduction in ductility after coating treatment, and a method for manufacturing the high-strength steel sheet. The term "formability", as used herein, refers to ductility, hole expansion formability, and bendability.

To solve the above problems and to manufacture a high-strength steel sheet with excellent formability, the present inventors have conducted extensive studies from the perspective of the chemical composition of the steel sheet and a method for manufacturing the steel sheet, and have found the following.

Specifically, 2.00% to 8.00% by mass Mn is contained, the chemical composition of other alloying elements, such as Ti, is appropriately adjusted, after hot rolling, the temperature range of the $Ac_1$ transformation temperature or lower is held for more than 1800 s as required, pickling treatment is performed as required, and cold rolling is performed. Subsequently, the temperature range of not less than the $Ac_3$ transformation temperature−50° C. is held for 20 s to 1800 s, cooling is performed to a cooling stop temperature of a martensitic transformation start temperature or lower, and reheating is performed to a reheating temperature in the range of 120° C. to 450° C. Subsequently, it was found that it is important to hold the reheating temperature for 2 s to 1800 s and perform cooling to room temperature, thereby producing film-like austenite with concentrated C serving as a nucleus of fine retained austenite with a high aspect ratio and with a much higher Mn and C content in a subsequent annealing step.

After cooling, the temperature range of not less than the $Ac_1$ transformation temperature−20° C. is held for 20 s to 600 s, cooling is performed to a cooling stop temperature of a martensitic transformation start temperature or lower, and reheating is performed to a reheating temperature in the range of 120° C. to 480° C. Subsequently, the reheating temperature is held for 2 s to 600 s, and cooling to room temperature is then performed. As a result, it has been found that a steel microstructure containing, on an area fraction basis, ferrite: 1% to 40%, fresh martensite: 1% to 20%, bainite and tempered martensite in total: 35% to 90%, and retained austenite: 6% or more is formed, and a high-strength steel sheet with excellent formability can be manufactured, wherein a value obtained by dividing an average Mn content (% by mass) of the retained austenite by an average Mn content (% by mass) of the ferrite is 1.1 or more, and a value obtained by dividing an average C content (% by mass) of retained austenite with an aspect ratio of 2.0 or more by an average C content (% by mass) of the ferrite is 3.0 or more, and a value obtained by dividing a C content of all retained austenite by a C content of a $T_0$ composition is 1.0 or more.

Aspects of the present invention are based on these findings and are summarized as follows:

[1] A high-strength steel sheet having a chemical composition containing, on a mass percent basis, C: 0.030% to 0.250%, Si: 0.01% to 3.00%, Mn: 2.00% to 8.00%, P: 0.100% or less, S: 0.0200% or less, N: 0.0100% or less, Al: 0.001% to 2.000%, and a remainder composed of Fe and incidental impurities, and a steel microstructure containing, on an area fraction basis, ferrite: 1% to 40%, fresh martensite: 1% to 20%, bainite and tempered martensite in total: 35% to 90%, and retained austenite: 6% or more, wherein a value obtained by dividing an average Mn content (% by mass) of the retained austenite by an average Mn content (% by mass) of the ferrite is 1.1 or more, and a value obtained by dividing an average C content (% by mass) of retained austenite with an aspect ratio of 2.0 or more by an average C content (% by mass) of the ferrite is 3.0 or more, and a value obtained by dividing a C content of all retained austenite by a C content of a $T_0$ composition is 1.0 or more.

[2] The high-strength steel sheet according to [1], wherein the chemical composition contains at least one element selected from Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.100% or less, Zr: 0.200% or less, Ca: 0.0050% or less, Mg: 0.0050% or less, and REM: 0.0050% or less, on a mass percent basis.

[3] The high-strength steel sheet according to [1] or [2], wherein a value obtained by dividing an area fraction of massive retained austenite by an area fraction of all retained austenite and massive fresh martensite is 0.5 or less.

[4] The high-strength steel sheet according to any one of [1] to [3], further including a galvanized layer on a surface thereof.

[5] The high-strength steel sheet according to [4], wherein the galvanized layer is a galvannealed layer.

[6] A method for manufacturing the high-strength steel sheet according to any one of [1] to [3], including: heating a steel slab with the chemical composition according to [1] or [2], hot rolling the steel slab at a finish rolling delivery temperature in the range of 750° C. to 1000° C., performing coiling at 300° C. to 750° C., performing cold rolling, holding in a temperature range of not less than Ac 3 transformation temperature−50° C. for 20 s to 1800 s, performing cooling to a cooling stop temperature of a martensitic transformation start temperature or lower, reheating to a reheating temperature in the range of 120° C. to 450° C. and holding the reheating temperature for 2 s to 1800 s, performing cooling to room temperature, holding in a temperature range of not less than $Ac_1$ transformation temperature−20° C. for 20 s to 600 s, performing cooling to a cooling stop temperature of the martensitic transformation start temperature or lower, reheating to a reheating temperature in the range of 120° C. to 480° C. and holding the reheating temperature for 2 s to 600 s, and performing cooling to room temperature.

[7] The method for manufacturing the high-strength steel sheet according to [6], further including performing galvanizing treatment.

[8] The method for manufacturing the high-strength steel sheet according to [7], including performing galvannealing at 450° C. to 600° C. after the galvanizing treatment.

[9] The method for manufacturing the high-strength steel sheet according to any one of [6] to [8], including holding in the temperature range of the $Ac_1$ transformation temperature or lower for more than 1800 s after the coiling and before the cold rolling.

Aspects of the present invention can provide a high-strength steel sheet with a TS (tensile strength) of 980 MPa or more, with excellent formability, particularly hole expansion formability and bendability as well as ductility, after coating treatment, and without a reduction in ductility after the coating treatment. A high-strength steel sheet manufactured by a manufacturing method according to aspect of the present invention can improve fuel efficiency due to the weight reduction of automobile bodies when used in automobile structural parts, for example, and has significantly high industrial utility value.

DETAILED DESCRIPTION OF EMBODIMENTS OF THE INVENTION

Embodiments of the present invention are specifically described below. Unless otherwise specified, "%" representing the component element content refers to "% by mass".

(1) the Reason for Limiting the Chemical Composition of Steel to the Above Ranges in Accordance with Aspects of the Present Invention is Described Below.

C: 0.030% to 0.250%

C is an element necessary to form a low-temperature transformed phase, such as martensite, to increase the strength. C is also an element effective in improving the stability of retained austenite and improving the ductility of steel. A C content of less than 0.030% results in undesired strength due to excessive formation of ferrite. Furthermore, it is difficult to achieve a sufficient area fraction of retained austenite and high ductility. On the other hand, an excessively high C content of more than 0.250% results in an excessively high area fraction of hard martensite, an increased number of micro voids at a grain boundary of martensite in a hole expansion test, propagation of a crack, and lower hole expansion formability. This also results in a significantly hardened weld or heat-affected zone, a weld with poorer mechanical properties, and lower spot weldability and arc weldability. From such a perspective, the C content ranges from 0.030% to 0.250%. A preferred lower limit is 0.080% or more. A preferred upper limit is 0.200% or less.

Si: 0.01% to 3.00%

Si improves the work hardenability of ferrite and is effective for high ductility. A Si content of less than 0.01% results in lower effects of the addition of Si. Thus, the lower limit is 0.01%. However, an excessive addition of more than 3.00% Si not only reduces ductility and bendability due to the embrittlement of steel but also reduces surface quality due to generation of red scale or the like. This also reduces the quality of coating. Thus, the Si content ranges from 0.01% to 3.00%. A preferred lower limit is 0.20% or more. The upper limit is preferably 2.00% or less, more preferably less than 1.20%.

Mn: 2.00% to 8.00%

Mn is a very important additive element in accordance with aspects of the present invention. Mn is an element that stabilizes retained austenite, is effective for high ductility, and increases the strength of steel through solid-solution strengthening. Such effects can be observed when the Mn content of steel is 2.00% or more. However, an excessive addition of more than 8.00% Mn reduces chemical convertibility and the quality of coating. From such a perspective, the Mn content ranges from 2.00% to 8.00%. The lower limit is preferably 2.30% or more, more preferably 2.50% or more. The upper limit is preferably 6.00% or less, more preferably 4.20% or less.

P: 0.100% or Less

P is an element that has a solid-solution strengthening effect and can be added according to desired strength. A P content of more than 0.100% results in lower weldability and, in galvannealing of a zinc coating, a lower alloying speed and a zinc coating with lower quality. The lower limit may be 0% and is preferably 0.001% or more in terms of production costs. Thus, the P content is 0.100% or less. A more preferred lower limit is 0.005% or more. A preferred upper limit is 0.050% or less.

S: 0.0200% or Less

S segregates at a grain boundary, embrittles steel during hot working, and forms a sulfide that impairs local deformability. Thus, the S content should be 0.0200% or less, preferably 0.0100% or less, more preferably 0.0050% or less. The lower limit may be 0% and is preferably 0.0001% or more in terms of production costs.

N: 0.0100% or Less

N is an element that reduces the aging resistance of steel. In particular, a N content of more than 0.0100% results in significantly lower aging resistance. The N content is preferably as low as possible, may have a lower limit of 0%, and is preferably 0.0005% or more in terms of production costs. Thus, the N content is 0.0100% or less. 0.0010% or more is more preferred. The upper limit of the N content is preferably 0.0070% or less.

Al: 0.001% to 2.000%

Al is an element that expands a two-phase region of ferrite and austenite and is effective in reducing the dependence of mechanical properties on the annealing temperature, that is, effective for the stability of mechanical properties. An Al content of less than 0.001% results in lower effects of the addition of Al. Thus, the lower limit is 0.001%. Al is an element that acts as a deoxidizing agent and is effective for the cleanliness of steel, and is preferably added in a deoxidizing step. However, the addition of a large amount of more than 2.000% increases the risk of billet cracking during continuous casting and reduces manufacturability. From such a perspective, the Al content ranges from 0.001% to 2.000%. The lower limit is preferably 0.025% or more, more preferably 0.200% or more. A preferred upper limit is 1.200% or less.

In addition to these components, at least one element selected from Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.1000% or less, Zr: 0.200% or less, Ca: 0.0050% or less, Mg: 0.0050% or less, and REM: 0.0050% or less, on a mass percent basis, may be contained.

Ti: 0.200% or Less

Ti is effective for the precipitation strengthening of steel, can improve the strength of ferrite and thereby reduce the hardness difference from a hard second phase (martensite or retained austenite), can ensure higher hole expansion formability, and may therefore be contained as required. However, more than 0.200% may result in an excessively high area fraction of hard martensite, an increased number of micro voids at a grain boundary of martensite in a hole expansion test, propagation of a crack, and lower hole expansion formability. Thus, when Ti is added, the addition amount of Ti is 0.200% or less. The lower limit is preferably 0.005% or more, more preferably 0.010% or more. A preferred upper limit is 0.100% or less.

Nb: 0.200% or Less, V: 0.500% or Less, W: 0.500% or Less

Nb, V, and W are effective for the precipitation strengthening of steel and, like the effects of the addition of Ti, can improve the strength of ferrite and thereby reduce the hardness difference from a hard second phase (martensite or retained austenite), can ensure higher hole expansion formability, and may therefore be contained as required. However, more than 0.200% Nb or more than 0.500% V or W may result in an excessively high area fraction of hard martensite, an increased number of micro voids at a grain boundary of martensite in a hole expansion test, propagation of a crack, and lower hole expansion formability. Thus, when Nb is added, the addition amount of Nb is 0.200% or less. The lower limit of Nb is preferably 0.005% or more, more preferably 0.010% or more. A preferred upper limit of Nb is 0.100% or less. When V and/or W is added, the addition amounts of V and/or W are independently 0.500% or less. The lower limits of V and W are independently preferably 0.005% or more, more preferably 0.010% or more. Preferred upper limits of V and W are independently 0.300% or less.

B: 0.0050% or Less

B has the effect of suppressing the formation and growth of ferrite from an austenite grain boundary, can improve the strength of ferrite and thereby reduce the hardness difference from a hard second phase (martensite or retained austenite), can ensure higher hole expansion formability, and may therefore be contained as required. However, more than 0.0050% may result in lower formability. Thus, when B is added, the addition amount of B is 0.0050% or less. The lower limit is preferably 0.0003% or more, more preferably 0.0005% or more. A preferred upper limit is 0.0030% or less.

Ni: 1.000% or Less

Ni is an element that stabilizes retained austenite, is effective for higher ductility, and increases the strength of steel through solid-solution strengthening, and may therefore be contained as required. On the other hand, the addition of more than 1.000% Ni results in an excessively high area fraction of hard martensite, an increased number of micro voids at a grain boundary of martensite in a hole expansion test, propagation of a crack, and lower hole expansion formability. Thus, when Ni is added, the addition amount of Ni is 1.000% or less, preferably 0.005% to 1.000%.

Cr: 1.000% or Less, Mo: 1.000% or Less

Cr and Mo have the effect of improving the balance between strength and ductility and may be added as required. However, an excessive addition of more than 1.000% Cr or more than 1.000% Mo may result in an excessively high area fraction of hard martensite, an increased number of micro voids at a grain boundary of martensite in a hole expansion test, propagation of a crack, and lower hole expansion formability. Thus, when these elements are added, each element content is Cr: 1.000% or less and Mo: 1.000% or less, preferably Cr: 0.005% to 1.000% and Mo: 0.005% to 1.000%.

Cu: 1.000% or Less

Cu is an element that is effective in strengthening steel, and may be used to strengthen steel as required within the range specified in accordance with aspects of the present invention. On the other hand, the addition of more than 1.000% Cu results in an excessively high area fraction of hard martensite, an increased number of micro voids at a grain boundary of martensite in a hole expansion test, propagation of a crack, and lower hole expansion formability. Thus, when Cu is added, the amount of Cu is 1.000% or less, preferably 0.005% to 1.000%.

Sn: 0.200% or Less, Sb: 0.200% or Less

Sn and Sb are added, as required, to suppress decarbonization in a region of tens of micrometers in a surface layer of a steel sheet caused by nitriding or oxidation of the surface of the steel sheet. They are effective in suppressing such nitriding and oxidation, preventing the decrease in the area fraction of martensite on the surface of a steel sheet, and ensuring the strength and the stability of mechanical properties, and may therefore be contained as required. On the other hand, for any of these elements, an excessive addition of more than 0.200% of the element results in lower toughness. Thus, when Sn and Sb are added, the Sn content and the Sb content are independently 0.200% or less, preferably 0.002% to 0.200%.

Ta: 0.100% or Less

Like Ti and Nb, Ta forms an alloy carbide or an alloy carbonitride and contributes to reinforcement. Furthermore, it is thought that Ta has the effect of significantly suppressing the coarsening of a precipitate by dissolving partially in Nb carbide or Nb carbonitride and forming a complex precipitate, such as (Nb, Ta) (C, N), and has the effect of stabilizing the contribution of precipitation strengthening to the strength. Thus, Ta may be contained as required. On the other hand, an excessive addition of Ta has a saturated precipitate stabilizing effect and increases the alloy cost. Thus, when Ta is added, the Ta content is 0.100% or less, preferably 0.001% to 0.100%.

Zr: 0.200% or Less

Zr is an element that is effective in spheroidizing the shape of a sulfide and reducing the adverse effects of the sulfide on bendability, and may therefore be contained as required. However, an excessive addition of more than 0.200% Zr increases the number of inclusions and causes surface and internal defects. Thus, when Zr is added, the addition amount of Zr is 0.200% or less, preferably 0.0005% to 0.200%.

Ca: 0.0050% or Less, Mg: 0.0050% or Less, REM: 0.0050% or Less

Ca, Mg, and REM are elements that are effective in spheroidizing the shape of a sulfide and reducing the adverse effects of the sulfide on hole expansion formability, and may therefore be contained as required. However, an excessive addition of more than 0.0050% Ca, Mg, or REM increases the number of inclusions and causes surface and internal defects. Thus, when Ca, Mg, and REM are added, each addition amount is 0.0050% or less, preferably 0.0005% to 0.0050%.

The remainder is composed of Fe and incidental impurities.

(2) Next, the Steel Microstructure is Described Below.

Area Fraction of Ferrite: 1% to 40%

To achieve sufficient ductility, the area fraction of ferrite should be 1% or more. To ensure a TS of 980 MPa or more, the area fraction of soft ferrite should be 40% or less. The term "ferrite", as used herein, refers to polygonal ferrite, granular ferrite, or acicular ferrite and is relatively soft and highly ductile ferrite. The area fraction preferably ranges from 3% to 30%.

Area Fraction of Fresh Martensite: 1% to 20%

To achieve a TS of 980 MPa or more, the area fraction of fresh martensite should be 1% or more. For high hole expansion formability, the area fraction of fresh martensite should be 20% or less. The area fraction preferably ranges from 3% to 18%.

Sum of Area Fractions of Bainite and Tempered Martensite: 35% to 90%

Bainite and tempered martensite are microstructures effective in increasing hole expansion formability. When the sum of the area fractions of bainite and tempered martensite is less than 35%, preferable hole expansion formability cannot be achieved. Thus, the sum of the area fractions of bainite and tempered martensite should be 35% or more. On the other hand, when the sum of the area fractions of bainite and tempered martensite is more than 90%, this results low ductility due to undesired retained austenite for ductility. Thus, the sum of the area fractions of bainite and tempered martensite should be 90% or less. The sum of the area fractions of bainite and tempered martensite preferably ranges from 45% to 85%.

The area fractions of ferrite, fresh martensite, tempered martensite, and bainite can be determined by polishing a thickness cross section (L cross section) of a steel sheet parallel to the rolling direction, etching the cross section in 3% by volume nital, observing 10 visual fields with a scanning electron microscope (SEM) at a magnification of 2000 times at a quarter thickness position (a position corresponding to one-fourth of the thickness in the depth direction from the surface of the steel sheet), calculating the area fraction of each microstructure (ferrite, fresh martensite, tempered martensite, and bainite) in the 10 visual fields from a captured microstructure image using Image-Pro available from Media Cybernetics, Inc., and averaging the area fractions. In the microstructure image, ferrite has a gray microstructure (base microstructure), fresh martensite has a white microstructure, tempered martensite has a gray internal structure inside the white martensite, and bainite has a dark gray microstructure with many linear grain boundaries.

Area Fraction of Retained Austenite: 6% or More

To achieve sufficient ductility, the area fraction of retained austenite should be 6% or more, preferably 8% or more, more preferably 10% or more.

The area fraction of retained austenite was determined by polishing a steel sheet to 0.1 mm from a quarter thickness position, chemically polishing the steel sheet by 0.1 mm, measuring integrated intensity ratios of diffraction peaks of {200}, {220}, and {311} planes of fcc iron and {200}, {211}, and {220} planes of bcc iron on the polished surface at the quarter thickness position with an X-ray diffractometer using Co Kα radiation, and averaging nine integrated intensity ratios thus measured.

Value Obtained by Dividing Average Mn Content (% by Mass) of Retained Austenite by Average Mn Content (% by Mass) of Ferrite: 1.1 or More It is an extremely important constituent feature according to aspects of the present invention that a value obtained by dividing the average Mn content (% by mass) of retained austenite by the average Mn content (% by mass) of ferrite is 1.1 or more. For high ductility, stable retained austenite containing concentrated Mn should have a high area fraction, preferably of 1.2 or more.

Value Obtained by Dividing Average C Content (% by Mass) of Retained Austenite with Aspect Ratio of 2.0 or More by Average C Content (% by Mass) of Ferrite: 3.0 or More It is a very important constituent feature according to aspects of the present invention that a value obtained by dividing the average C content (% by mass) of retained austenite with an aspect ratio (major axis/minor axis) of 2.0 or more by the average C content (% by mass) of ferrite is 3.0 or more. For high bendability, stable retained austenite containing concentrated C should have a high area fraction, preferably of 5.0 or more. The upper limit of the aspect ratio of retained austenite may preferably be, but is not limited to, 20.0 or less.

The C and Mn contents of retained austenite and ferrite can be determined by quantifying the distribution state of Mn in each phase in a cross section in the rolling direction at a quarter thickness position using a field emission-electron probe micro analyzer (FE-EPMA) and averaging the C and Mn content analysis results of 30 retained austenite grains and 30 ferrite grains.

To identify retained austenite in the retained austenite and martensite, a visual field was observed with a scanning electron microscope (SEM) and by electron backscattered diffraction (EBSD). Retained austenite in a SEM image was then identified by Phase Map identification of EBSD. The aspect ratio of retained austenite was calculated by drawing an ellipse circumscribing a retained austenite grain using Photoshop elements 13 and dividing the major axis length by the minor axis length.

Value Obtained by Dividing C Content of all Retained Austenite by C Content of $T_0$ Composition: 1.0 or More It is an extremely important constituent feature according to aspects of the present invention that a value obtained by dividing a C content of all retained austenite by a C content of a $T_0$ composition is 1.0 or more. The $T_0$ composition is a composition in which the free energy of fcc and the free energy of bcc are the same at a certain temperature, and austenite is fcc, and ferrite or bainite is bcc. A C content of all retained austenite higher than the C content of the $T_0$ composition in which the free energy of fcc and the free energy of bcc are the same can suppress the decomposition of retained austenite during coating treatment, thus resulting in a desired amount of retained austenite. This can prevent a reduction in ductility, which has hitherto been reduced by coating treatment, and can ensure high ductility. Thus, a value obtained by dividing the C content of all retained austenite by the C content of the $T_0$ composition should be 1.0 or more, preferably 1.1 or more.

Using an X-ray diffractometer and Co Kα radiation, the C content of all retained austenite is calculated from the shift amount of a diffraction peak of a (220) plane using the following formulae [1] and [2]:

$$a=1.7889\times\sqrt{2}/\sin\theta \quad [1]$$

$$a=3.578+0.033[C]+0.00095[Mn] \quad [2]$$

In the formulae [1] and [2], a denotes the lattice constant (angstroms) of austenite, and θ denotes a value (rad) obtained by dividing the diffraction peak angle of the (220) plane by 2. In the formula [2], [M] denotes the mass percentage of an element M in all austenite. In accordance with aspects of the present invention, the mass percentage of the element M in retained austenite is based on the total mass of steel.

The C content of the $T_0$ composition can be calculated unambiguously from the composition of steel and its content using integrated thermodynamic calculation software Thermo-Calc and database TCFE7. The $T_0$ composition for calculation is the composition calculated at the reheating temperature before immersion in a galvanizing bath.

Furthermore, a value obtained by multiplying a value obtained by dividing the average Mn content (% by mass) of retained austenite by the average Mn content (% by mass) of ferrite and the average aspect ratio of the retained austenite together is preferably 3.0 or more. High ductility requires a high area fraction of stable retained austenite with a high aspect ratio containing concentrated Mn. 4.0 or more is preferred. A preferred upper limit is 20.0 or less.

Furthermore, the value obtained by dividing the area fraction of massive retained austenite by the area fraction of all retained austenite and massive fresh martensite is preferably 0.5 or less. Massive retained austenite has high stability due to constraint from surrounding crystal grains and therefore has martensitic transformation in a high strain region at the time of punching. This may increase the hardness difference from the surrounding grains and reduce hole expansion formability. Thus, the value obtained by dividing the area fraction of massive retained austenite by the area fraction of all retained austenite and massive fresh martensite is preferably 0.5 or less, more preferably 0.4 or less. The massive retained austenite is austenite with an aspect ratio of less than 2.0. The massive retained austenite may have any average grain size, for example, an average grain size of 3 μm or less. The average grain size can be determined by a known method, for example, by image analysis of a microstructure image of massive retained austenite captured with a scanning electron microscope (SEM).

Aspects of the present invention retain the advantages even if a steel microstructure in accordance with aspects of the present invention contains 10% or less by area of pearlite and carbides such as cementite, other than ferrite, fresh martensite, bainite, tempered martensite, and retained austenite.

A high-strength steel sheet described above may further have a galvanized layer. The galvanized layer may be further subjected to galvannealing, i.e., galvannealed layer.

(3) Next, the Manufacturing Conditions are Described Below.

The heating temperature of a steel slab is preferably, but not limited to, in the range of 1100° C. to 1300° C. A precipitate present while heating a steel slab is present as a coarse precipitate in a steel sheet finally manufactured and does not contribute to the strength. Thus, Ti and Nb precipitates precipitated during casting are preferably redissolved. Thus, the heating temperature of a steel slab is preferably 1100° C. or more. The heating temperature of a steel slab is preferably 1100° C. or more to eliminate defects, such as bubbles and segregation, in a slab surface layer, to reduce cracks and unevenness in the surface of a steel sheet, and to smooth the surface of the steel sheet. On the other hand, when the heating temperature of a steel slab is more than 1300° C., the scale loss increases with the amount of oxidation. Thus, the heating temperature of a steel slab is preferably 1300° C. or less, more preferably 1150° C. to 1250° C.

To prevent macrosegregation, a steel slab is preferably manufactured by continuous casting but may also be manufactured by ingot casting, thin slab casting, or the like. After a steel slab is manufactured, the steel slab may be cooled to room temperature and subsequently reheated by a known method. Alternatively, without cooling to room temperature, a steel slab may be subjected without problems to an energy-saving process, such as hot charge rolling, in which the hot slab is conveyed directly into a furnace or is immediately rolled after short warming. A slab is formed into a sheet bar by rough rolling under typical conditions. At a low heating temperature, to avoid troubles during hot rolling, the sheet bar is preferably heated with a bar heater or the like before finish rolling.

Finish Rolling Delivery Temperature in Hot Rolling: 750° C. to 1000° C.

A steel slab after heating is hot-rolled into a hot-rolled steel sheet by rough rolling and finish rolling. A finishing temperature of more than 1000° C. tends to result in a rapidly increased amount of oxide (scale), a rough interface between the steel substrate and the oxide, and poor surface quality after pickling and cold rolling. Hot-rolling scale partially remaining after pickling adversely affects ductility and hole expansion formability. This may also excessively increase the grain size and result in a pressed product with a rough surface during processing. On the other hand, a finishing temperature of less than 750° C. results in not only increased rolling force, increased rolling load, a high rolling reduction in a non-recrystallized austenite state, a developed abnormal texture, remarkable in-plane anisotropy in the end product, lower material uniformity (stability of mechanical properties), but also lower ductility. Thus, the finish rolling delivery temperature in hot rolling should range from 750° C. to 1000° C., preferably 800° C. to 950° C.

Coiling Temperature after Hot Rolling: 300° C. To 750° C.

A coiling temperature of more than 750° C. after hot rolling results in ferrite with a larger grain size in the hot-rolled steel sheet microstructure, making it difficult to manufacture a final annealed sheet with desired strength. On the other hand, a coiling temperature of less than 300° C. after hot rolling results in a hot-rolled steel sheet with increased strength, increased rolling load in cold rolling, a defect in sheet shape, and consequently lower productivity. Thus, the coiling temperature after hot rolling should range from 300° C. to 750° C., preferably 400° C. to 650° C.

Rough-rolled sheets may be joined together during hot rolling to continuously perform finish rolling. A rough-rolled sheet may be coiled once. Furthermore, to reduce the rolling force during hot rolling, finish rolling may be partly or entirely rolling with lubrication. Rolling with lubrication is also effective in making the shape and the material quality of a steel sheet uniform. The friction coefficient in rolling with lubrication preferably ranges from 0.10 to 0.25.

A hot-rolled steel sheet thus manufactured is subjected to pickling, if necessary. Pickling can remove an oxide from the surface of a steel sheet and is therefore preferably performed to ensure high chemical convertibility and quality of coating of a high-strength steel sheet of the end product. Pickling may be performed once or multiple times.

Cold Rolling

After coiling and, if necessary, pickling, cold rolling is performed. The cold-rolling reduction is preferably, but not limited to, in the range of 5% to 60%.

Holding in the Temperature Range of $Ac_1$ Transformation Temperature or Lower for More than 1800 s Holding in the temperature range of the $Ac_1$ transformation temperature or lower for more than 1800 s can soften a steel sheet to be subjected to subsequent cold rolling and is therefore performed as required. Holding in the temperature range above the $Ac_1$ transformation temperature may concentrate Mn in austenite, form hard martensite and retained austenite after cooling, and does not necessarily soften a steel sheet. Holding for 1800 s or less does not necessarily remove strain after hot rolling and soften a steel sheet.

A heat treatment method may be any annealing method of continuous annealing or batch annealing. The heat treatment is followed by cooling to room temperature. The cooling method and the cooling rate are not particularly specified, and any cooling method, such as furnace cooling or natural cooling in batch annealing or gas jet cooling, mist cooling, or water cooling in continuous annealing, may be used. Pickling may be performed in the usual manner.

Holding in the Temperature Range of not Less than $Ac_3$ Transformation Temperature−50° C. for 20 s to 1800 s (Corresponding to First Annealing Treatment of a Cold-Rolled Steel Sheet of an Example)

Holding in a temperature range below the $Ac_3$ transformation temperature−50° C. concentrates Mn in austenite, causes no martensitic transformation during cooling, and cannot form a nucleus of retained austenite with a high aspect ratio. Consequently, in a subsequent annealing step (corresponding to second annealing treatment of a cold-rolled steel sheet of an example), retained austenite is formed from a grain boundary, retained austenite with a low aspect ratio increases, a desired microstructure cannot be formed, and the hole expansion formability is deteriorated.

Holding for less than 20 s results in insufficient recrystallization, an undesired microstructure, and lower hole expansion formability. This also results in insufficient surface concentration of Mn to ensure the quality of coating after that.

On the other hand, holding for more than 1800 s results in not only coating with lower quality due to excessive surface concentration of Mn, but also coarsening of a nucleus of retained austenite formed in a subsequent cooling process due to coarsening of austenite grains during annealing, insufficient concentration of C of the $T_0$ composition, and lower ductility after coating.

Cooling to a Cooling Stop Temperature of a Martensitic Transformation Start Temperature or Lower At a cooling stop temperature above the martensitic transformation start temperature, a small amount of martensite to be transformed results in martensitic transformation of all untransformed austenite in the final cooling and cannot form a nucleus of retained austenite with a high aspect ratio. Consequently, in a subsequent annealing step (corresponding to second annealing treatment of a cold-rolled steel sheet of an example), retained austenite is formed from a grain boundary, retained austenite with a low aspect ratio increases, a desired microstructure cannot be formed, and the ductility and hole expansion formability are deteriorated. The martensitic transformation start temperature−250° C. to the martensitic transformation start temperature−50° C. is preferred.

Reheating to a Reheating Temperature in the Range of 120° C. to 450° C., Holding at the Reheating Temperature for 2 s to 1800 s, and then Cooling to Room Temperature A reheating temperature of less than 120° C. results in no concentration of C in retained austenite formed in a subsequent annealing step, an undesired microstructure, and lower ductility, bendability, and ductility after coating. A reheating temperature of more than 450° C. results in the decomposition of a nucleus of retained austenite with a high aspect ratio, increased retained austenite with a low aspect ratio, an undesired microstructure, and lower ductility. Similarly, holding for less than 2 s results in no nucleus of retained austenite with a high aspect ratio, an undesired microstructure, and lower ductility, bendability, and ductility after coating. Holding for more than 1800 s results in the decomposition of a nucleus of retained austenite with a high aspect ratio, increased retained austenite with a low aspect ratio, an undesired microstructure, and lower ductility.

After the reheating followed by holding for a predetermined time, cooling to room temperature is temporarily performed. The cooling method may be, but is not limited to, a known method.

Holding in the Temperature Range of not Less than $Ac_1$ Transformation Temperature−20° C. for 20 s to 600 s (Corresponding to Second Annealing Treatment of a Cold-Rolled Steel Sheet of an Example)

In accordance with aspects of the present invention, holding in the temperature range of not less than the $Ac_1$ transformation temperature−20° C. for 20 s to 600 s is a extremely important constituent feature according to aspects of the invention. Holding in a temperature range below the $Ac_1$ transformation temperature−20° C. for less than 20 s results in a carbide formed during heating remaining dissolved and makes it difficult to form sufficient area fractions of martensite and retained austenite, thus resulting in lower strength. The $Ac_1$ transformation temperature or higher is preferred. The $Ac_1$ transformation temperature+20° C. to the $Ac_3$ transformation temperature+50° C. is more preferred. Furthermore, holding for more than 600 s results in coarsening of austenite during annealing, insufficient diffusion of Mn into the austenite, and unconcentrated Mn, and cannot form a sufficient area fraction of retained austenite for ensuring the ductility.

Cooling to a Cooling Stop Temperature of a Martensitic Transformation Start Temperature or Lower A cooling stop temperature above the martensitic transformation temperature results in a small amount of martensite to be transformed, a small amount of martensite to be tempered by subsequent reheating, and an undesired amount of tempered martensite. The martensitic transformation start temperature−250° C. to the martensitic transformation start temperature−30° C. is preferred.

Reheating to a Reheating Temperature in the Range of 120° C. to 480° C., Holding at the Reheating Temperature for 2 s to 600 s, and then Cooling to Room Temperature Reheating at less than 120° C. cannot temper fresh martensite and cannot form a desired microstructure. A reheating temperature above 480° C. results in delayed bainite transformation and an undesired microstructure. Holding for less than 2 s cannot form a desired microstructure due to insufficient progress of bainite transformation. On the other hand, holding for more than 600 s causes precipitation of a carbide during bainite transformation, decreases the C content of retained austenite, and cannot form a desired microstructure.

After holding the temperature for a predetermined time, cooling to room temperature is performed. The cooling method may be, but is not limited to, a known method.

Galvanizing Treatment

A high-strength steel sheet thus manufactured is subjected to galvanizing treatment as required. In hot-dip galvanizing treatment, a steel sheet subjected to the annealing is immersed in a galvanizing bath in the temperature range of 440° C. to 500° C. to perform the hot-dip galvanizing treatment, and the amount of coating is then adjusted by gas wiping or the like. The hot-dip galvanizing is preferably performed in a galvanizing bath at an Al content in the range of 0.08% to 0.30%.

For galvannealing of a hot-dip zinc coating, after the hot-dip galvanizing treatment, the zinc coating is subjected to galvannealing in the temperature range of 450° C. to 600° C. Galvannealing at a temperature of more than 600° C. may transform untransformed austenite into pearlite, does not necessarily form a desired area fraction of retained austenite, and may reduce the ductility. Thus, for galvannealing of a zinc coating, the zinc coating is preferably subjected to the galvannealing in the temperature range of 450° C. to 600° C.

Although other conditions of the manufacturing method are not particularly limited, the annealing is preferably performed in a continuous annealing system from the perspective of productivity. A series of annealing, hot-dip galvanizing, galvannealing of a zinc coating, and the like are preferably performed on a continuous galvanizing line (CGL), which is a hot-dip galvanizing line.

The "high-strength steel sheet" and "high-strength hot-dip galvanized steel sheet" may be subjected to temper rolling for the purpose of shape correction, adjustment of surface roughness, or the like. The rolling reduction of the temper rolling preferably ranges from 0.1% to 2.0%. Less than 0.1% results in a small effect and difficult control and is therefore the lower limit of an appropriate range. On the other hand, more than 2.0% results in much lower productivity and is therefore the upper limit of the appropriate range. The temper rolling may be performed on-line or off-line. Furthermore, temper with a desired rolling reduction may be performed at one time or several times. It is also possible to apply coating treatment, such as resin or oil coating.

EXAMPLES

A steel with the chemical composition listed in Table 1 and with the remainder composed of Fe and incidental impurities was obtained by steelmaking in a converter and was formed into a slab by continuous casting. After the slab was reheated to 1250° C., a high-strength cold-rolled steel sheet (CR) was manufactured under the conditions shown in Tables 2 and 3 and was subjected to galvanizing treatment to manufacture a hot-dip galvanized steel sheet (GI) and a hot-dip galvannealed steel sheet (GA). CR, GI, and GA had a thickness in the range of 1.0 mm to 1.8 mm. For the hot-dip galvanized steel sheet (GI), a zinc bath containing 0.19% by mass Al was used as a hot-dip galvanizing bath. For the hot-dip galvannealed steel sheet (GA), a zinc bath containing 0.14% by mass Al was used. The bath temperature was 465° C. The amount of coating was 45 g/m2 per side (double-sided coating). For GA, the concentration of Fe in the coated layer was adjusted in the range of 9% to 12% by mass. A steel microstructure of a cross section of a steel sheet thus manufactured was observed by the method described above, and tensile properties, hole expansion formability, bendability, and coatability were investigated. Tables 4 to 6 show the results.

TABLE 1

| Type of steel | Chemical composition (% by mass) | | | | | | | | | | | | | | | | | | | | | | | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| | C | Si | Mn | P | S | N | Al | Ti | Nb | V | W | B | Ni | Cr | Mo | Cu | Sn | Sb | Ta | Ca | Mg | Zr | REM | | | | |
| A | 0.167 | 0.77 | 3.51 | 0.022 | 0.0023 | 0.0035 | 0.031 | 0.028 | — | — | — | — | — | — | — | — | — | — | — | — | — | — | — | 352 | 659 | 774 | Steel of present invention |
| B | 0.185 | 0.90 | 2.81 | 0.009 | 0.0009 | 0.0040 | 0.049 | 0.031 | — | — | — | — | — | — | — | — | — | — | — | — | — | — | — | 374 | 679 | 801 | Steel of present invention |
| C | 0.175 | 1.78 | 3.35 | 0.017 | 0.0017 | 0.0022 | 0.035 | 0.051 | — | — | — | — | — | — | — | — | — | — | — | — | — | — | — | 356 | 674 | 832 | Steel of present invention |
| D | 0.248 | 0.97 | 3.28 | 0.028 | 0.0011 | 0.0025 | 0.058 | — | — | — | — | — | — | — | — | — | — | — | — | — | — | — | — | 334 | 666 | 766 | Steel of present invention |
| E | 0.048 | 0.98 | 4.11 | 0.029 | 0.0025 | 0.0024 | 0.029 | — | — | — | — | — | — | — | — | — | — | — | — | — | — | — | — | 370 | 646 | 792 | Steel of present invention |
| F | 0.179 | 2.91 | 3.99 | 0.025 | 0.0018 | 0.0026 | 0.033 | 0.025 | — | — | — | — | — | — | — | — | — | — | — | — | — | — | — | 329 | 668 | 852 | Steel of present |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| | | | | | | | | | | | | | | | | | | | | | | | | | | | invention |
| G | 0.198 | 0.58 | 3.52 | 0.033 | 0.0018 | 0.0034 | 0.039 | 0.051 | — | — | — | — | — | — | — | — | — | — | — | — | — | — | — | 341 | 656 | 768 | Steel of present invention |
| H | 0.079 | 1.03 | 5.12 | 0.024 | 0.0026 | 0.0033 | 0.045 | — | — | — | — | — | — | — | — | — | — | — | — | — | — | — | — | 319 | 618 | 755 | Steel of present invention |
| I | 0.179 | 1.48 | 3.76 | 0.019 | 0.0020 | 0.0024 | 0.035 | — | — | — | — | — | — | — | — | — | — | — | — | — | — | — | — | 338 | 659 | 785 | Steel of present invention |
| J | 0.160 | 0.19 | 3.50 | 0.027 | 0.0022 | 0.0036 | 0.029 | 0.044 | — | — | — | — | — | — | — | — | — | — | — | — | — | — | — | 355 | 653 | 756 | Steel of present invention |
| K | 0.123 | 0.35 | 5.96 | 0.027 | 0.0027 | 0.0031 | 0.031 | 0.050 | — | — | — | — | — | — | — | — | — | — | — | — | — | — | — | 269 | 586 | 702 | Steel of present invention |
| L | 0.189 | 0.43 | 2.32 | 0.023 | 0.0024 | 0.0030 | 0.036 | — | — | — | — | — | — | — | — | — | — | — | — | — | — | — | — | 392 | 688 | 779 | Steel of present |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| | | | | | | | | | | | | | | | | | | | | | | | | | | | invention |
| M | 0.153 | 0.59 | 4.17 | 0.021 | 0.0027 | 0.0030 | 0.036 | — | — | — | — | — | — | — | — | — | — | — | — | — | — | — | — | 331 | 638 | 739 | Steel of present invention |
| N | 0.195 | 0.88 | 2.55 | 0.029 | 0.0021 | 0.0040 | 0.040 | — | — | — | — | — | — | — | — | — | — | — | — | — | — | — | — | 381 | 686 | 791 | Steel of present invention |
| 0 | 0.159 | 0.83 | 3.45 | 0.017 | 0.0017 | 0.0034 | 0.708 | 0.041 | — | — | — | — | — | — | — | — | — | — | — | — | — | — | — | 378 | 661 | 921 | Steel of present invention |
| P | 0.155 | 0.59 | 3.55 | 0.019 | 0.0026 | 0.0032 | 1.180 | 0.044 | — | — | — | — | — | — | — | — | — | — | — | — | — | — | — | 389 | 656 | 1004 | Steel of present invention |
| Q | 0.198 | 0.35 | 3.51 | 0.026 | 0.0025 | 0.0043 | 0.225 | — | — | — | — | — | — | — | — | — | — | — | — | — | — | — | — | 347 | 653 | 775 | Steel of present invention |
| R | 0.022 | 0.40 | 3.55 | 0.021 | 0.0022 | 0.0035 | 0.029 | 0.048 | — | — | — | — | — | — | — | — | — | — | — | — | — | — | — | 401 | 656 | 816 | Comparative steel |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| S | 0.204 | 4.07 | 3.47 | 0.027 | 0.0023 | 0.0036 | 0.031 | — | — | — | — | — | — | — | — | — | — | — | — | — | — | — | — | 341 | 695 | 904 | Comparative steel |
| T | 0.186 | 0.30 | 8.33 | 0.025 | 0.0023 | 0.0026 | 0.035 | — | — | — | — | — | — | — | — | — | — | — | — | — | — | — | — | 153 | 518 | 593 | Comparative steel |
| U | 0.157 | 0.74 | 1.93 | 0.017 | 0.0019 | 0.0030 | 0.032 | 0.018 | — | — | — | — | — | — | — | — | — | — | — | — | — | — | — | 419 | 703 | 819 | Comparative steel |
| V | 0.164 | 0.60 | 2.54 | 0.020 | 0.0019 | 0.0039 | 0.042 | 0.255 | — | — | — | — | — | — | — | — | — | — | — | — | — | — | — | 392 | 684 | 889 | Comparative steel |
| W | 0.144 | 0.75 | 3.48 | 0.021 | 0.0024 | 0.0037 | 0.038 | — | 0.041 | — | — | — | — | — | — | — | — | — | — | — | — | — | — | 362 | 660 | 770 | Steel of present invention |
| X | 0.157 | 0.70 | 4.47 | 0.031 | 0.0023 | 0.0038 | 0.044 | 0.010 | 0.021 | — | — | — | — | — | — | — | — | — | — | — | — | — | — | 318 | 631 | 740 | Steel of present invention |
| Y | 0.121 | 1.13 | 3.58 | 0.033 | 0.0025 | 0.0026 | 0.045 | 0.089 | — | 0.150 | — | — | — | — | — | — | — | — | — | — | — | — | — | 361 | 661 | 843 | Steel of present invention |
| Z | 0.099 | 1.17 | 4.09 | 0.029 | 0.0025 | 0.0032 | 0.043 | — | — | — | 0.025 | — | — | — | — | — | — | — | — | — | — | — | — | 353 | 648 | 785 | Steel of present in- |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| | | | | | | | | | | | | | | | | | | | | | | | | | | | vention |
| AA | 0.148 | 0.37 | 3.42 | 0.033 | 0.0024 | 0.0044 | 0.038 | 0.021 | — | — | — | 0.0021 | — | — | — | — | — | — | — | — | — | — | — | 363 | 657 | 762 | Steel of present invention |
| AB | 0.190 | 0.68 | 5.95 | 0.024 | 0.0022 | 0.0039 | 0.016 | 0.013 | — | — | — | — | 0.252 | — | — | — | — | — | — | — | — | — | — | 242 | 585 | 678 | Steel of present invention |
| AC | 0.094 | 0.50 | 6.36 | 0.022 | 0.0024 | 0.0037 | 0.056 | 0.063 | — | — | — | — | — | 0.048 | — | — | — | — | — | — | — | — | — | 263 | 578 | 716 | Steel of present invention |
| AD | 0.127 | 0.70 | 3.69 | 0.020 | 0.0026 | 0.0035 | 0.060 | 0.049 | — | — | — | — | — | 0.444 | — | — | — | — | — | — | — | — | — | 351 | 659 | 795 | Steel of present invention |
| AE | 0.102 | 1.44 | 3.10 | 0.027 | 0.0025 | 0.0032 | 0.031 | 0.025 | — | — | — | — | — | — | 0.053 | — | — | — | — | — | — | — | — | 391 | 679 | 835 | Steel of present invention |
| AF | 0.109 | 0.51 | 3.57 | 0.024 | 0.0023 | 0.0027 | 0.042 | — | — | — | — | — | — | — | — | 0.198 | — | — | — | — | — | — | — | 368 | 654 | 763 | Steel of present in- |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| | | | | | | | | | | | | | | | | | | | | | | | | | | | vention |
| AG | 0.120 | 0.56 | 3.19 | 0.025 | 0.0020 | 0.0034 | 0.035 | 0.034 | — | — | — | — | — | — | — | — | 0.006 | — | — | — | — | — | — | 381 | 666 | 790 | Steel of present invention |
| AH | 0.159 | 0.41 | 3.23 | 0.018 | 0.0022 | 0.0024 | 0.035 | 0.093 | — | — | — | — | — | — | — | — | — | 0.051 | — | — | — | — | — | 366 | 663 | 795 | Steel of present invention |
| AI | 0.135 | 0.69 | 3.57 | 0.018 | 0.0019 | 0.0029 | 0.029 | — | — | — | — | — | — | — | — | — | — | — | 0.007 | — | — | — | — | 361 | 656 | 765 | Steel of present invention |
| AJ | 0.201 | 0.38 | 2.98 | 0.033 | 0.0030 | 0.0025 | 0.030 | — | 0.015 | — | — | — | — | — | — | — | 0.008 | — | — | — | — | — | — | 361 | 669 | 753 | Steel of present invention |
| AK | 0.211 | 0.22 | 3.72 | 0.025 | 0.0027 | 0.0038 | 0.033 | — | 0.030 | — | — | — | — | — | — | — | — | — | 0.009 | — | — | — | — | 328 | 646 | 722 | Steel of present invention |
| AL | 0.212 | 0.95 | 3.96 | 0.024 | 0.0026 | 0.0039 | 0.042 | — | — | — | — | — | — | — | — | — | — | — | — | 0.0034 | — | — | — | 319 | 647 | 749 | Steel of present in- |

TABLE 1-continued

| Type of steel | Chemical composition (% by mass) C | Si | Mn | P | S | N | Al | Ti | Nb | V | W | B | Ni | Cr | Mo | Cu | Sn | Sb | Ta | Ca | Mg | Zr | REM | Ms temperature (° C.) | $Ac_1$ transformation temperature (° C.) | $Ac_3$ transformation temperature (° C.) | Notes |
|---|---|---|---|---|---|---|---|---|---|---|---|---|---|---|---|---|---|---|---|---|---|---|---|---|---|---|---|
| AM | 0.197 | 1.24 | 3.80 | 0.022 | 0.0022 | 0.0035 | 0.035 | — | — | — | — | — | — | — | — | — | — | — | — | — | 0.0050 | — | — | 330 | 655 | 769 | Steel of present invention |
| AN | 0.242 | 0.02 | 3.03 | 0.024 | 0.0024 | 0.0029 | 0.038 | 0.007 | — | — | — | — | — | — | — | — | — | — | — | — | — | 0.0033 | — | 345 | 663 | 731 | Steel of present invention |
| AO | 0.078 | 0.05 | 6.11 | 0.020 | 0.0029 | 0.0035 | 0.039 | — | — | — | — | — | — | — | — | — | — | — | — | — | — | — | 0.0025 | 279 | 579 | 680 | Steel of present invention |

Underlined portion: outside the scope of the present invention.
— denotes a content corresponding to the incidental impurity level.

The martensitic transformation start temperature, the $Ac_1$ transformation temperature, and the $Ac_3$ transformation temperature were determined using the following formulae:

Martensitic transformation start temperature (° C.)=550−350×(% C)−40×(% Mn)−10×(% Cu)−17×(% Ni)−20×(% Cr)−10×(% Mo)−35×(% V)−5×(% W)+30×(% Al)

$Ac_1$ transformation temperature (° C.)=751−16×(% C)+11×(% Si)−28×(% Mn)−5.5×(% Cu)−16×(% Ni)+13×(% Cr)+3.4×(% Mo)

$Ac_3$ transformation temperature (° C.)=910−203√(% C)+45×(% Si)−30×(% Mn)−20×(% Cu)−15×(% Ni)+11×(% Cr)+32×(% Mo)+104×(% V)+400×(% Ti)+200×(% Al)

(% C), (% Si), (% Mn), (% Ni), (% Cu), (% Cr), (% Mo), (% V), (% Ti), (% W), and (% Al) denote their respective element contents (% by mass) and are zero if not contained.

TABLE 2

| No. | Type of steel | Finish rolling delivery temperature (° C.) | Coiling temperature (° C.) | Hot-rolled steel sheet heat treatment: Heat-treatment temperature (° C.) | Hot-rolled steel sheet heat treatment: Heat-treatment time (s) | Cold-rolling reduction (%) | First annealing treatment of cold-rolled steel sheet: Heat-treatment temperature (° C.) | First annealing treatment of cold-rolled steel sheet: Heat-treatment time (s) | First annealing treatment of cold-rolled steel sheet: Cooling stop temperature (° C.) | First annealing treatment of cold-rolled steel sheet: Reheating temperature (° C.) | First annealing treatment of cold-rolled steel sheet: Reheating temperature holding time (s) | Second annealing treatment of cold-rolled steel sheet: Heat-treatment temperature (° C.) | Second annealing treatment of cold-rolled steel sheet: Heat-treatment time (s) | Second annealing treatment of cold-rolled steel sheet: Cooling stop temperature (° C.) | Second annealing treatment of cold-rolled steel sheet: Reheating temperature (° C.) | Second annealing treatment of cold-rolled steel sheet: Reheating temperature holding time (s) | Galvannealing temperature (° C.) | Type* |
|---|---|---|---|---|---|---|---|---|---|---|---|---|---|---|---|---|---|---|
| 1 | A | 880 | 530 | 550 | 21600 | 46.2 | 850 | 120 | 175 | 280 | 250 | 690 | 150 | 180 | 250 | 340 | 530 | GA |
| 2 | A | 890 | 550 | 540 | 23400 | 41.7 | 800 | 150 | 180 | 300 | 300 | 700 | 180 | 180 | 200 | 250 | | GI |
| 3 | A | 880 | 530 | 530 | 18000 | 50.0 | 850 | 90 | 150 | 250 | 240 | 740 | 55 | 170 | 400 | 80 | | CR |
| 4 | A | 900 | 520 | 560 | 18000 | 50.0 | 820 | 180 | 200 | 250 | 230 | 760 | 120 | 150 | 400 | 120 | 520 | GA |
| 5 | A | 830 | 490 | 550 | 23400 | 47.1 | 850 | 160 | 150 | 200 | 150 | 780 | 150 | 200 | 380 | 150 | | GI |
| 6 | A | 920 | 520 | 500 | 14400 | 56.5 | 600 | 160 | 220 | 330 | 250 | 660 | 150 | 220 | 280 | 150 | | GI |
| 7 | A | 910 | 430 | 600 | 18000 | 46.2 | 900 | 15 | 250 | 350 | 140 | 810 | 25 | 240 | 280 | 130 | 520 | GA |
| 8 | A | 800 | 460 | 620 | 18000 | 39.1 | 780 | 2400 | 80 | 130 | 270 | 800 | 240 | 80 | 180 | 250 | 510 | GA |
| 9 | A | 870 | 560 | 570 | 36000 | 64.7 | 800 | 200 | 400 | 430 | 190 | 680 | 200 | 230 | 440 | 180 | | GI |
| 10 | A | 850 | 550 | | | 56.3 | 750 | 250 | 300 | 500 | 220 | 800 | 250 | 150 | 370 | 215 | 490 | GA |
| 11 | A | 820 | 440 | 500 | 14400 | 64.7 | 800 | 120 | 50 | 100 | 310 | 680 | 120 | 50 | 150 | 300 | 560 | GA |
| 12 | A | 850 | 520 | 600 | 8000 | 58.8 | 810 | 50 | 210 | 180 | 2000 | 700 | 50 | 120 | 200 | 540 | | CR |
| 13 | A | 850 | 380 | 530 | 9000 | 58.8 | 820 | 360 | 240 | 300 | 1 | 820 | 360 | 240 | 300 | 200 | | GI |
| 14 | A | 860 | 490 | | | 46.2 | 800 | 250 | 180 | 275 | 640 | 775 | 250 | 180 | 275 | 500 | 540 | GA |
| 15 | B | 910 | 500 | 580 | 21600 | 53.3 | 820 | 200 | 200 | 410 | 650 | 775 | 90 | 200 | 400 | 100 | 490 | GA |
| 16 | C | 890 | 520 | 560 | 21600 | 46.7 | 850 | 150 | 250 | 300 | 200 | 790 | 150 | 120 | 300 | 180 | 550 | GA |
| 17 | A | 870 | 620 | 750 | 21600 | 58.8 | 860 | 180 | 110 | 200 | 80 | 720 | 180 | 250 | 300 | 60 | | GI |
| 18 | A | 850 | 560 | 430 | 36000 | 50.0 | 800 | 300 | 200 | 200 | 360 | 620 | 300 | 120 | 200 | 370 | 500 | GA |
| 19 | A | 860 | 540 | 550 | 18000 | 57.1 | 790 | 360 | 180 | 330 | 520 | 860 | 360 | 225 | 320 | 520 | 490 | GA |
| 20 | A | 900 | 550 | 540 | 7200 | 50.0 | 780 | 150 | 150 | 180 | 180 | 810 | 1 | 150 | 390 | 170 | 530 | GA |
| 21 | A | 860 | 580 | 520 | 21600 | 57.1 | 750 | 180 | 210 | 250 | 280 | 730 | 900 | 110 | 250 | 260 | 540 | GA |
| 22 | A | 850 | 540 | | | 46.2 | 780 | 150 | 200 | 330 | 150 | 770 | 100 | 370 | 410 | 160 | | GI |
| 23 | A | 850 | 550 | | | 46.2 | 830 | 250 | 300 | 330 | 220 | 775 | 250 | 300 | 490 | 220 | 510 | GA |
| 24 | A | 820 | 440 | 610 | 14400 | 53.8 | 830 | 120 | 50 | 320 | 290 | 800 | 120 | 75 | 110 | 300 | 510 | GA |
| 25 | A | 880 | 520 | 500 | 21600 | 61.1 | 830 | 50 | 250 | 300 | 320 | 805 | 50 | 180 | 280 | 720 | | GI |
| 26 | A | 860 | 380 | 520 | 32400 | 64.7 | 840 | 360 | 240 | 290 | 250 | 820 | 360 | 200 | 290 | 1 | | GI |
| 27 | D | 910 | 550 | 540 | 28800 | 50.0 | 820 | 1200 | 140 | 260 | 80 | 760 | 480 | 140 | 410 | 180 | | GI |
| 28 | E | 800 | 560 | 560 | 18000 | 58.8 | 880 | 360 | 280 | 320 | 240 | 675 | 360 | 180 | 300 | 240 | | CR |
| 29 | F | 940 | 600 | 570 | 18000 | 57.1 | 850 | 150 | 180 | 280 | 550 | 790 | 150 | 180 | 415 | 540 | 560 | GA |
| 30 | G | 800 | 610 | 550 | 23400 | 57.1 | 830 | 140 | 100 | 250 | 120 | 700 | 140 | 100 | 250 | 130 | 510 | GA |
| 31 | H | 850 | 500 | 580 | 9000 | 53.3 | 840 | 120 | 200 | 320 | 270 | 745 | 120 | 180 | 380 | 270 | 530 | GA |
| 32 | I | 910 | 560 | 530 | 23400 | 50.0 | 875 | 100 | 150 | 340 | 570 | 775 | 150 | 160 | 340 | 570 | 540 | GA |
| 33 | J | 870 | 500 | 510 | 28800 | 52.9 | 780 | 180 | 200 | 300 | 30 | 730 | 180 | 130 | 300 | 30 | | GI |
| 34 | K | 880 | 450 | 520 | 21600 | 48.6 | 790 | 90 | 60 | 200 | 220 | 630 | 90 | 60 | 200 | 220 | | GI |
| 35 | L | 880 | 580 | 560 | 36000 | 46.2 | 800 | 90 | 225 | 280 | 150 | 740 | 100 | 170 | 360 | 150 | 515 | GA |
| 36 | M | 950 | 610 | 580 | 23400 | 62.5 | 830 | 130 | 200 | 250 | 150 | 680 | 150 | 150 | 290 | 150 | 520 | GA |
| 37 | N | 890 | 580 | 530 | 21600 | 62.5 | 820 | 180 | 200 | 400 | 180 | 775 | 120 | 200 | 410 | 180 | 495 | GA |

Underlined portion: outside the scope of the present invention.

*CR: cold-rolled steel sheet, GI: hot-dip galvanized steel sheet (no galvannealing of zinc coating), GA: hot-dip galvannealed steel sheet

TABLE 3

| No. | Type of steel | Finish rolling delivery temperature (° C.) | Coiling temperature (° C.) | Hot-rolled steel sheet heat treatment: Heat-treatment temperature (° C.) | Hot-rolled steel sheet heat treatment: Heat-treatment time (s) | Cold rolling reduction (%) | First annealing treatment of cold-rolled steel sheet: Heat-treatment temperature (° C.) | First annealing treatment of cold-rolled steel sheet: Heat-treatment time (s) | First annealing treatment of cold-rolled steel sheet: Cooling stop temperature (° C.) | First annealing treatment of cold-rolled steel sheet: Reheating temperature (° C.) | First annealing treatment of cold-rolled steel sheet: Reheating temperature holding time (s) | Second annealing treatment of cold-rolled steel sheet: Heat-treatemtn temperature (° C.) | Second annealing treatment of cold-rolled steel sheet: Heat-treatment time (s) | Second annealing treatment of cold-rolled steel sheet: Cooling stop temperature (° C.) | Second annealing treatment of cold-rolled steel sheet: Reheating temperature (° C.) | Second annealing treatment of cold-rolled steel sheet: Reheating temperature holding time (s) | Galvannealing temperature (° C.) | Type* |
|---|---|---|---|---|---|---|---|---|---|---|---|---|---|---|---|---|---|---|
| 38 | O | 870 | 510 | 520 | 10800 | 50.0 | 910 | 320 | 250 | 350 | 540 | 700 | 150 | 150 | 250 | 120 | 500 | GA |
| 39 | P | 750 | 480 | | | 52.0 | 980 | 330 | 150 | 330 | 400 | 880 | 180 | 200 | 400 | 100 | 520 | GA |
| 40 | Q | 880 | 540 | 600 | 9000 | 50.0 | 980 | 350 | 210 | 320 | 80 | 695 | 120 | 125 | 300 | 240 | | CR |
| 41 | R | 885 | 550 | | | 46.2 | 830 | 180 | 300 | 350 | 90 | 720 | 150 | 200 | 350 | 80 | 515 | GA |
| 42 | S | 890 | 650 | 550 | 7200 | 60.0 | 870 | 600 | 320 | 420 | 190 | 730 | 150 | 180 | 350 | 80 | 540 | GA |
| 43 | T | 850 | 480 | 480 | 10800 | 64.7 | 650 | 60 | 50 | 180 | 190 | 630 | 90 | 125 | 320 | 360 | | GI |
| 44 | U | 900 | 540 | 520 | 36000 | 57.1 | 880 | 100 | 240 | 400 | 100 | 770 | 200 | 225 | 410 | 180 | | GI |
| 45 | V | 860 | 600 | 560 | 28800 | 50.0 | 880 | 90 | 250 | 400 | 500 | 725 | 250 | 180 | 370 | 220 | | CR |
| 46 | W | 910 | 500 | | | 56.3 | 890 | 120 | 200 | 330 | 180 | 760 | 120 | 200 | 350 | 300 | 520 | GA |
| 47 | X | 900 | 550 | 510 | 36000 | 46.2 | 840 | 150 | 180 | 320 | 360 | 760 | 50 | 220 | 400 | 540 | 520 | GA |
| 48 | Y | 870 | 550 | 570 | 14400 | 52.9 | 850 | 140 | 100 | 200 | 170 | 715 | 360 | 240 | 300 | 200 | | GI |
| 49 | Z | 905 | 330 | | | 47.1 | 825 | 300 | 220 | 300 | 300 | 740 | 250 | 180 | 400 | 500 | 510 | GA |
| 50 | AA | 890 | 610 | 530 | 28800 | 33.3 | 820 | 1200 | 300 | 405 | 240 | 755 | 420 | 200 | 420 | 100 | 520 | GA |
| 51 | AB | 830 | 540 | 530 | 18000 | 56.3 | 840 | 140 | 140 | 180 | 270 | 730 | 150 | 120 | 300 | 150 | | GI |
| 52 | AC | 870 | 740 | 520 | 23400 | 58.8 | 800 | 60 | 120 | 150 | 160 | 660 | 180 | 250 | 300 | 90 | | GI |
| 53 | AD | 885 | 610 | 590 | 21600 | 53.3 | 900 | 240 | 180 | 350 | 100 | 700 | 300 | 200 | 380 | 300 | 530 | GA |
| 54 | AE | 880 | 500 | 520 | 23400 | 64.7 | 900 | 120 | 250 | 330 | 210 | 830 | 360 | 250 | 380 | 110 | | GI |
| 55 | AF | 900 | 500 | 570 | 9000 | 62.5 | 830 | 150 | 180 | 210 | 150 | 690 | 100 | 200 | 400 | 170 | 500 | GA |
| 56 | AG | 910 | 580 | 510 | 28800 | 39.1 | 840 | 150 | 200 | 320 | 200 | 730 | 900 | 180 | 350 | 260 | 510 | GA |
| 57 | AH | 855 | 580 | | | 53.8 | 820 | 160 | 150 | 280 | 180 | 770 | 100 | 200 | 410 | 160 | 520 | GA |
| 58 | Al | 900 | 560 | 520 | 32400 | 56.3 | 900 | 320 | 95 | 180 | 190 | 720 | 250 | 200 | 300 | 220 | | G |
| 59 | AJ | 900 | 550 | 540 | 10800 | 56.3 | 900 | 180 | 100 | 200 | 125 | 750 | 120 | 200 | 320 | 300 | 530 | GA |
| 60 | AK | 880 | 520 | 540 | 14400 | 56.3 | 800 | 240 | 180 | 275 | 180 | 680 | 120 | 180 | 340 | 500 | | GI |
| 61 | AL | 850 | 550 | 510 | 10800 | 50.0 | 825 | 150 | 170 | 200 | 180 | 720 | 360 | 200 | 390 | 150 | 480 | GA |
| 62 | AM | 860 | 530 | | | 46.7 | 850 | 90 | 210 | 300 | 240 | 710 | 90 | 220 | 320 | 100 | | CR |
| 63 | AN | 840 | 510 | 560 | 21600 | 50.0 | 840 | 150 | 225 | 305 | 180 | 700 | 500 | 150 | 400 | 150 | 540 | GA |
| 64 | AO | 850 | 490 | 515 | 9000 | 57.1 | 830 | 350 | 200 | 275 | 510 | 660 | 350 | 150 | 420 | 150 | 510 | GA |

Underlined portion: outside the scope of the present invention.

*CR: cold-rolled steel sheet, GI: hot-dip galvanized steel sheet (no galvannealing of zinc coating), GA: hot-dip galvannealed steel sheet

TABLE 4

| No. | Type of steel | Thickness (mm) | Area fraction of F (%) | Area fraction of M (%) | Sum of B and TM (%) | Area fraction of RA (%) | Area fraction of massive RA with an average grain size of 3 μm or less/sum of area fractions of all RA and M | Average Mn content of RA (% by mass) | Average Mn content of F (% by mass) | Average Mn content of RA/average Mn content of F |
|---|---|---|---|---|---|---|---|---|---|---|
| 1 | A | 1.4 | 33.8 | 5.1 | 41.6 | 17.5 | 0.42 | 6.55 | 2.11 | 3.10 |
| 2 | A | 1.4 | 30.4 | 8.3 | 42.1 | 19.0 | 0.45 | 6.79 | 2.83 | 2.40 |
| 3 | A | 1.6 | 5.9 | 3.6 | 74.3 | 15.8 | 0.21 | 4.89 | 2.00 | 2.45 |
| 4 | A | 1.6 | 3.4 | 4.3 | 75.2 | 15.8 | 0.08 | 4.50 | 2.78 | 1.62 |
| 5 | A | 1.8 | 5.3 | 4.4 | 78.1 | 11.4 | 0.15 | 4.28 | 2.74 | 1.56 |
| 6 | A | 1.0 | 30.5 | 21.8 | 25.5 | 18.2 | 0.56 | 6.56 | 2.16 | 3.04 |
| 7 | A | 1.4 | 5.3 | 50.5 | 27.7 | 11.3 | 0.08 | 5.27 | 3.12 | 1.69 |
| 8 | A | 1.4 | 10.3 | 4.2 | 60.2 | 17.3 | 0.75 | 6.75 | 2.80 | 2.41 |
| 9 | A | 1.2 | 28.5 | 23.4 | 42.8 | 3.1 | 0.40 | 3.62 | 3.47 | 1.04 |
| 10 | A | 1.4 | 15.5 | 8.7 | 70.1 | 3.5 | 0.33 | 3.59 | 3.49 | 1.03 |
| 11 | A | 1.2 | 20.3 | 9.8 | 60.8 | 5.1 | 0.20 | 8.77 | 2.63 | 3.33 |
| 12 | A | 1.4 | 29.8 | 8.7 | 40.1 | 5.4 | 0.22 | 3.54 | 3.48 | 1.02 |
| 13 | A | 1.4 | 33.5 | 8.6 | 45.3 | 5.2 | 0.33 | 6.10 | 2.81 | 2.17 |
| 14 | A | 1.4 | 2.2 | 9.5 | 70.6 | 15.5 | 0.09 | 4.48 | 1.71 | 2.62 |
| 15 | B | 1.4 | 15.2 | 6.4 | 60.3 | 15.5 | 0.13 | 4.05 | 1.25 | 3.24 |
| 16 | C | 1.6 | 8.1 | 9.4 | 66.6 | 10.8 | 0.17 | 4.49 | 1.81 | 2.48 |
| 17 | A | 1.4 | 34.7 | 22.6 | 22.0 | 18.2 | 0.98 | 5.63 | 2.48 | 2.27 |
| 18 | A | 1.4 | 60.6 | 0.3 | 16.0 | 2.4 | 0.40 | 6.01 | 0.88 | 6.81 |
| 19 | A | 1.2 | 2.0 | 9.9 | 79.8 | 8.2 | 0.21 | 4.55 | 3.10 | 1.47 |
| 20 | A | 1.4 | 65.7 | 0.4 | 12.7 | 1.1 | 0.29 | 4.56 | 2.56 | 1.78 |
| 21 | A | 1.2 | 39.4 | 20.7 | 35.5 | 4.3 | 0.36 | 4.26 | 2.98 | 1.43 |
| 22 | A | 1.4 | 6.5 | 74.3 | 1.6 | 16.6 | 0.40 | 5.92 | 3.04 | 1.95 |
| 23 | A | 1.4 | 6.6 | 3.2 | 45.5 | 8.4 | 0.56 | 4.16 | 2.97 | 1.40 |
| 24 | A | 1.2 | 7.1 | 41.6 | 38.9 | 12.3 | 0.37 | 4.39 | 2.71 | 1.62 |
| 25 | A | 1.4 | 2.2 | 4.5 | 80.5 | 10.9 | 0.14 | 4.56 | 2.80 | 1.63 |
| 26 | A | 1.2 | 7.2 | 14.3 | 63.3 | 10.0 | 0.19 | 4.14 | 2.10 | 1.97 |
| 27 | D | 1.4 | 4.7 | 3.5 | 70.5 | 19.9 | 0.37 | 10.02 | 3.10 | 3.23 |
| 28 | E | 1.4 | 28.5 | 5.0 | 46.0 | 20.0 | 0.35 | 7.90 | 2.89 | 2.73 |
| 29 | F | 1.2 | 2.2 | 3.1 | 77.4 | 17.1 | 0.07 | 4.65 | 2.27 | 2.05 |
| 30 | G | 1.2 | 31.3 | 8.0 | 45.3 | 14.4 | 0.17 | 10.99 | 4.45 | 2.47 |
| 31 | H | 1.4 | 8.1 | 8.8 | 64.0 | 15.3 | 0.30 | 6.11 | 2.88 | 2.12 |
| 32 | 1 | 1.4 | 2.1 | 7.9 | 78.4 | 11.1 | 0.20 | 8.23 | 2.45 | 3.35 |
| 33 | J | 1.6 | 3.0 | 8.0 | 75.3 | 9.8 | 0.13 | 5.99 | 2.92 | 2.05 |
| 34 | K | 1.8 | 30.4 | 8.5 | 40.2 | 17.9 | 0.39 | 7.81 | 3.20 | 2.44 |
| 35 | L | 1.4 | 3.0 | 9.6 | 70.0 | 15.0 | 0.11 | 7.89 | 1.91 | 4.14 |
| 36 | M | 1.2 | 36.6 | 7.5 | 40.5 | 14.3 | 0.01 | 6.95 | 2.24 | 3.10 |
| 37 | N | 1.2 | 38.0 | 9.1 | 36.8 | 16.0 | 0.07 | 5.52 | 2.45 | 2.25 |
| 38 | O | 1.4 | 28.6 | 5.7 | 42.1 | 20.1 | 0.43 | 7.15 | 2.65 | 2.70 |
| 39 | P | 1.2 | 5.5 | 4.8 | 70.1 | 15.2 | 0.31 | 6.90 | 2.98 | 2.32 |
| 40 | Q | 1.4 | 23.4 | 5.7 | 45.8 | 21.4 | 0.37 | 9.93 | 6.12 | 1.62 |
| 41 | R | 1.4 | 46.5 | 3.4 | 42.5 | 4.8 | 0.38 | 3.71 | 2.57 | 1.44 |
| 42 | S | 1.2 | 30.1 | 6.8 | 50.1 | 12.1 | 0.07 | 4.93 | 2.12 | 2.32 |
| 43 | T | 1.2 | 18.3 | 4.2 | 45.7 | 26.7 | 0.34 | 13.50 | 3.10 | 4.35 |
| 44 | U | 1.2 | 6.5 | 8.8 | 71.3 | 4.0 | 0.20 | 2.66 | 2.03 | 1.31 |
| 45 | V | 1.4 | 23.1 | 21.5 | 40.0 | 12.2 | 0.06 | 5.22 | 2.41 | 2.17 |
| 46 | W | 1.4 | 10.2 | 4.2 | 71.3 | 10.0 | 0.35 | 5.11 | 3.02 | 1.69 |
| 47 | X | 1.4 | 11.1 | 7.0 | 68.5 | 12.7 | 0.23 | 5.24 | 2.56 | 2.05 |
| 48 | Y | 1.6 | 22.1 | 8.1 | 50.2 | 19.3 | 0.44 | 4.86 | 2.93 | 1.66 |
| 49 | Z | 1.8 | 4.1 | 4.7 | 69.5 | 12.0 | 0.43 | 5.44 | 4.21 | 1.29 |
| 50 | AA | 1.6 | 2.8 | 5.5 | 75.5 | 15.3 | 0.21 | 4.80 | 3.03 | 1.58 |
| 51 | AB | 1.4 | 5.2 | 6.6 | 70.1 | 16.8 | 0.11 | 9.98 | 2.10 | 4.75 |
| 52 | AC | 1.4 | 32.0 | 4.8 | 40.2 | 22.8 | 0.34 | 10.44 | 1.93 | 5.41 |
| 53 | AD | 1.4 | 10.2 | 5.1 | 71.3 | 11.3 | 0.04 | 4.96 | 3.02 | 1.64 |
| 54 | AE | 1.2 | 9.3 | 4.1 | 69.9 | 13.6 | 0.06 | 5.07 | 2.93 | 1.73 |
| 55 | AF | 1.2 | 28.5 | 3.8 | 50.1 | 15.8 | 0.47 | 4.36 | 2.74 | 1.59 |
| 56 | AG | 1.4 | 21.1 | 11.5 | 42.3 | 20.4 | 0.43 | 5.58 | 3.00 | 1.86 |
| 57 | AH | 1.2 | 5.9 | 8.6 | 66.6 | 15.5 | 0.23 | 6.43 | 3.28 | 1.96 |
| 58 | Al | 1.4 | 30.1 | 7.6 | 41.5 | 20.5 | 0.44 | 6.89 | 2.62 | 2.63 |
| 59 | AJ | 1.4 | 33.1 | 2.9 | 42.2 | 21.0 | 0.40 | 5.42 | 2.54 | 2.13 |
| 60 | AK | 1.4 | 32.7 | 5.1 | 43.1 | 17.8 | 0.40 | 4.79 | 1.71 | 2.80 |
| 61 | AL | 1.2 | 2.7 | 9.1 | 77.6 | 10.5 | 0.07 | 5.01 | 2.04 | 2.46 |
| 62 | AM | 1.6 | 22.7 | 7.3 | 50.1 | 18.5 | 0.33 | 4.99 | 2.85 | 1.75 |
| 63 | AN | 1.4 | 10.5 | 9.7 | 66.1 | 8.1 | 0.14 | 5.32 | 2.75 | 1.93 |
| 64 | AO | 1.2 | 6.7 | 8.9 | 71.8 | 11.0 | 0.07 | 12.07 | 4.50 | 2.68 |

Underlined portion: outside the scope of the present invention.

F: ferrite,

M: fresh martensite,

RA: retained austenite

TM: tempered martensite,

B: bainite

TABLE 5

| No. | Average C content of RA with an aspect ratio of 2.0 or more (% by mass) | Average C content of F (% by mass) | Average C content of RA with an aspect ratio of 2.0 or more/ Average C content of F | Average aspect ratio of RA | Average Mn content of RA/ average Mn content of F × average aspect ratio of RA | C content of RA (% by mass) | C content of $T_0$ composition (% by mass) | C content of RA/C content of $T_0$ composition | Remaining micro-structure |
|---|---|---|---|---|---|---|---|---|---|
| 1 | 0.48 | 0.05 | 9.43 | 5.40 | 16.76 | 0.68 | 0.65 | 1.04 | P, θ |
| 2 | 0.41 | 0.04 | 10.25 | 4.34 | 10.41 | 0.73 | 0.68 | 1.07 | P, θ |
| 3 | 0.46 | 0.03 | 15.33 | 5.10 | 12.47 | 1.16 | 0.71 | 1.63 | P, θ |
| 4 | 0.42 | 0.05 | 8.77 | 4.89 | 7.92 | 1.08 | 0.71 | 1.52 | P, θ |
| 5 | 0.45 | 0.11 | 4.09 | 5.14 | 8.03 | 1.01 | 0.69 | 1.46 | P, θ |
| 6 | 0.44 | 0.06 | 7.33 | 4.45 | 13.51 | 0.78 | 0.68 | 1.15 | P, θ |
| 7 | 0.34 | 0.04 | 8.50 | 3.94 | 6.66 | 0.71 | 0.65 | 1.09 | P, θ |
| 8 | 0.34 | 0.09 | 3.78 | 4.54 | 10.94 | 0.66 | 0.71 | 0.93 | P, θ |
| 9 | 0.27 | 0.11 | 2.45 | 0.99 | 1.03 | 0.70 | 0.68 | 1.03 | P, θ |
| 10 | 0.38 | 0.05 | 8.04 | 1.19 | 1.22 | 1.16 | 0.62 | 1.87 | P, θ |
| 11 | 0.21 | 0.14 | 1.50 | 3.65 | 12.16 | 0.48 | 0.65 | 0.74 | P, θ |
| 12 | 0.48 | 0.08 | 6.00 | 1.28 | 1.30 | 0.91 | 0.71 | 1.28 | P, θ |
| 13 | 0.28 | 0.11 | 2.55 | 1.32 | 2.87 | 0.59 | 0.71 | 0.83 | P, θ |
| 14 | 0.44 | 0.10 | 4.40 | 5.14 | 13.47 | 1.03 | 0.65 | 1.58 | P, θ |
| 15 | 0.45 | 0.11 | 4.09 | 4.24 | 13.74 | 1.12 | 0.70 | 1.60 | P, θ |
| 16 | 0.46 | 0.09 | 5.11 | 3.53 | 8.76 | 0.66 | 0.63 | 1.05 | P, θ |
| 17 | 0.45 | 0.05 | 8.78 | 1.07 | 2.43 | 0.79 | 0.68 | 1.16 | P, θ |
| 18 | 0.40 | 0.08 | 5.00 | 2.63 | 17.90 | 0.71 | 0.65 | 1.10 | P, θ |
| 19 | 0.36 | 0.12 | 3.00 | 1.91 | 2.80 | 0.92 | 0.66 | 1.39 | P, θ |
| 20 | 0.32 | 0.08 | 4.00 | 2.54 | 4.52 | 0.77 | 0.65 | 1.19 | P, θ |
| 21 | 0.33 | 0.10 | 3.30 | 3.83 | 5.48 | 0.73 | 0.68 | 1.07 | P, θ |
| 22 | 0.38 | 0.12 | 3.17 | 4.70 | 9.15 | 1.22 | 0.71 | 1.72 | P, θ |
| 23 | 0.31 | 0.12 | 2.58 | 5.13 | 7.19 | 0.35 | 0.62 | 0.56 | P, θ |
| 24 | 0.32 | 0.07 | 4.28 | 5.38 | 8.72 | 0.71 | 0.65 | 1.09 | P, θ |
| 25 | 0.48 | 0.02 | 24.00 | 6.21 | 10.13 | 0.44 | 0.62 | 0.71 | P, θ |
| 26 | 0.29 | 0.11 | 2.64 | 5.11 | 10.07 | 0.57 | 0.62 | 0.91 | P, θ |
| 27 | 0.51 | 0.04 | 12.75 | 4.01 | 12.96 | 1.00 | 0.67 | 1.49 | P, θ |
| 28 | 0.49 | 0.06 | 8.17 | 4.59 | 12.55 | 0.75 | 0.55 | 1.35 | P, θ |
| 29 | 0.50 | 0.08 | 6.42 | 5.38 | 11.03 | 0.96 | 0.70 | 1.37 | P, θ |
| 30 | 0.50 | 0.03 | 6.25 | 4.68 | 11.56 | 1.04 | 0.62 | 1.68 | P, θ |
| 31 | 0.32 | 0.04 | 8.00 | 6.30 | 13.37 | 0.87 | 0.59 | 1.47 | P, θ |
| 32 | 0.45 | 0.11 | 4.02 | 5.50 | 18.45 | 1.12 | 0.71 | 1.59 | P, θ |
| 33 | 0.51 | 0.05 | 10.20 | 8.32 | 17.07 | 0.77 | 0.71 | 1.09 | P, θ |
| 34 | 0.41 | 0.08 | 5.13 | 6.41 | 15.64 | 0.54 | 0.51 | 1.05 | P, θ |
| 35 | 0.44 | 0.02 | 19.68 | 3.30 | 13.65 | 0.88 | 0.65 | 1.36 | P, θ |
| 36 | 0.32 | 0.06 | 5.33 | 4.98 | 15.45 | 0.88 | 0.63 | 1.39 | P, θ |
| 37 | 0.28 | 0.03 | 9.33 | 2.90 | 6.53 | 0.84 | 0.71 | 1.19 | P, θ |
| 38 | 0.38 | 0.02 | 18.95 | 5.15 | 13.90 | 0.72 | 0.71 | 1.02 | P, θ |
| 39 | 0.47 | 0.03 | 15.67 | 4.45 | 10.30 | 0.81 | 0.68 | 1.19 | P, θ |
| 40 | 0.45 | 0.07 | 6.39 | 6.44 | 10.45 | 0.79 | 0.71 | 1.11 | P, θ |
| 41 | 0.15 | 0.01 | 15.00 | 4.23 | 6.11 | 0.71 | 0.68 | 1.05 | P, θ |
| 42 | 0.50 | 0.11 | 4.55 | 5.45 | 12.66 | 1.03 | 0.66 | 1.55 | P, θ |
| 43 | 0.40 | 0.05 | 8.00 | 4.10 | 17.85 | 0.52 | 0.28 | 1.87 | P, θ |
| 44 | 0.47 | 0.06 | 7.91 | 5.31 | 6.96 | 0.91 | 0.83 | 1.10 | P, θ |
| 45 | 0.50 | 0.06 | 8.33 | 4.28 | 9.27 | 0.99 | 0.79 | 1.25 | P, θ |
| 46 | 0.52 | 0.06 | 8.67 | 5.10 | 8.63 | 0.78 | 0.66 | 1.18 | P, θ |
| 47 | 0.53 | 0.08 | 6.63 | 6.17 | 12.63 | 0.77 | 0.61 | 1.27 | P, θ |
| 48 | 0.46 | 0.08 | 5.75 | 6.06 | 10.05 | 1.07 | 0.63 | 1.71 | P, θ |
| 49 | 0.48 | 0.05 | 9.60 | 4.57 | 5.91 | 1.17 | 0.65 | 1.81 | P, θ |
| 50 | 0.42 | 0.04 | 10.50 | 5.42 | 8.59 | 1.19 | 0.66 | 1.81 | P, θ |
| 51 | 0.49 | 0.03 | 16.33 | 5.33 | 25.33 | 0.77 | 0.47 | 1.63 | P, θ |
| 52 | 0.35 | 0.06 | 5.64 | 6.03 | 32.62 | 0.64 | 0.45 | 1.41 | P, θ |
| 53 | 0.44 | 0.09 | 4.89 | 5.88 | 9.66 | 0.69 | 0.64 | 1.07 | P, θ |
| 54 | 0.35 | 0.09 | 4.02 | 4.05 | 7.01 | 0.88 | 0.71 | 1.24 | P, θ |
| 55 | 0.43 | 0.05 | 8.60 | 5.13 | 8.16 | 0.70 | 0.65 | 1.09 | P, θ |
| 56 | 0.35 | 0.11 | 3.18 | 4.78 | 8.89 | 0.84 | 0.71 | 1.19 | P, θ |
| 57 | 0.41 | 0.09 | 4.37 | 5.35 | 10.49 | 0.99 | 0.73 | 1.36 | P, θ |
| 58 | 0.46 | 0.07 | 6.57 | 4.16 | 10.94 | 1.08 | 0.62 | 1.74 | P, θ |
| 59 | 0.45 | 0.08 | 5.63 | 5.56 | 11.86 | 0.81 | 0.66 | 1.23 | P, θ |
| 60 | 0.41 | 0.08 | 5.13 | 4.53 | 12.69 | 0.87 | 0.60 | 1.46 | P, θ |
| 61 | 0.44 | 0.09 | 4.89 | 4.53 | 11.13 | 1.08 | 0.62 | 1.73 | P, θ |
| 62 | 0.40 | 0.10 | 4.00 | 5.10 | 8.93 | 0.72 | 0.65 | 1.11 | P, θ |
| 63 | 0.39 | 0.06 | 6.50 | 6.12 | 11.84 | 1.03 | 0.68 | 1.52 | P, θ |
| 64 | 0.53 | 0.04 | 15.75 | 5.05 | 13.55 | 1.01 | 0.41 | 2.47 | P, θ |

Underlined portion: outside the scope of the present invention.

F: ferrite,

RA: retained austenite,

P: pearlite,

θ: carbide (cementite etc.)

TABLE 6

| No. | TS (MPa) | EL (%) | EL' (%) | λ (%) | R (mm) | R/t | EL/EL' | Coatability | Notes |
|---|---|---|---|---|---|---|---|---|---|
| 1 | 995 | 22.5 | 22.8 | 22 | 2.5 | 1.8 | 0.99 | ◎ | Example |
| 2 | 1035 | 24.9 | 25.4 | 21 | 3.0 | 2.1 | 0.98 | ◎ | Example |
| 3 | 1221 | 18.8 | 18.8 | 48 | 2.0 | 1.3 | 1.00 | | Example |
| 4 | 1234 | 16.9 | 19.6 | 39 | 2.5 | 1.6 | 0.86 | ◎ | Example |
| 5 | 1255 | 16.8 | 18.2 | 41 | 4.0 | 2.2 | 0.92 | ◎ | Example |
| 6 | 1024 | 25.9 | 28.2 | 12 | 2.0 | 2.0 | 0.92 | ◎ | Comparative example |
| 7 | 1250 | 14.0 | 14.5 | 14 | 3.0 | 2.1 | 0.96 | x | Comparative example |
| 8 | 1251 | 13.1 | 21.2 | 25 | 2.0 | 1.4 | 0.62 | x | Comparative example |
| 9 | 1010 | 18.2 | 19.9 | 10 | 4.0 | 3.3 | 0.91 | ◎ | Comparative example |
| 10 | 1270 | 10.9 | 12.1 | 30 | 3.0 | 2.1 | 0.90 | ◎ | Comparative example |
| 11 | 1020 | 16.2 | 25.3 | 21 | 3.5 | 2.9 | 0.64 | ◎ | Comparative example |
| 12 | 1031 | 15.3 | 15.3 | 19 | 3.0 | 2.1 | 1.00 | | Comparative example |
| 13 | 998 | 16.2 | 25.9 | 25 | 5.5 | 3.9 | 0.63 | ◎ | Comparative example |
| 14 | 1257 | 14.8 | 18.3 | 44 | 3.0 | 2.1 | 0.81 | ◎ | Example |
| 15 | 1054 | 122.7 | 26.8 | 40 | 1.5 | 1.1 | 0.85 | ◎ | Example |
| 16 | 1198 | 20.1 | 21.1 | 35 | 3.0 | 1.9 | 0.95 | ◎ | Example |
| 17 | 1023 | 23.2 | 24.2 | 11 | 2.0 | 1.4 | 0.96 | ◎ | Comparative example |
| 18 | 884 | 24.8 | 25.9 | 29 | 0.5 | 0.4 | 0.96 | ◎ | Comparative example |
| 19 | 1181 | 12.1 | 16.0 | 26 | 1.0 | 0.8 | 0.76 | ◎ | Example |
| 20 | 945 | 25.6 | 28.9 | 28 | 1.5 | 1.1 | 0.88 | ◎ | Comparative example |
| 21 | 999 | 13.6 | 13.9 | 10 | 1.0 | 0.8 | 0.98 | ◎ | Comparative example |
| 22 | 1235 | 15.4 | 15.9 | 21 | 2.5 | 1.8 | 0.97 | ◎ | Comparative example |
| 23 | 1211 | 13.5 | 21.1 | 40 | 5.0 | 3.6 | 0.64 | ◎ | Comparative example |
| 24 | 1243 | 16.1 | 16.7 | 17 | 3.0 | 2.5 | 0.96 | ◎ | Comparative example |
| 25 | 1199 | 16.5 | 26.2 | 28 | 1.5 | 1.1 | 0.63 | ◎ | Comparative example |
| 26 | 1195 | 12.6 | 21.5 | 45 | 5.0 | 4.2 | 0.59 | ◎ | Comparative example |
| 27 | 1202 | 18.9 | 19.7 | 26 | 1.0 | 0.7 | 0.96 | ◎ | Example |
| 28 | 1036 | 21.1 | 21.1 | 22 | 3.0 | 2.1 | 1.00 | | Example |
| 29 | 1189 | 18.5 | 20.5 | 38 | 3.0 | 2.5 | 0.90 | ○ | Example |
| 30 | 1005 | 21.0 | 21.4 | 30 | 2.5 | 2.1 | 0.98 | ◎ | Example |
| 31 | 1192 | 16.5 | 18.2 | 42 | 2.5 | 1.8 | 0.91 | ◎ | Example |
| 32 | 1194 | 16.9 | 19.6 | 40 | 2.5 | 1.8 | 0.86 | ◎ | Example |
| 33 | 1211 | 14.0 | 14.4 | 41 | 3.0 | 1.9 | 0.97 | ◎ | Example |
| 34 | 996 | 22.5 | 22.6 | 28 | 3.0 | 1.7 | 1.00 | ○ | Example |
| 35 | 1223 | 12.5 | 15.1 | 27 | 2.5 | 1.8 | 0.83 | ◎ | Example |
| 36 | 1066 | 21.5 | 23.6 | 29 | 3.0 | 2.5 | 0.91 | ◎ | Example |
| 37 | 1100 | 24.4 | 25.8 | 51 | 2.5 | 2.1 | 0.95 | ◎ | Example |
| 38 | 990 | 22.2 | 24.5 | 27 | 2.5 | 1.8 | 0.91 | ◎ | Example |
| 39 | 1185 | 15.1 | 19.8 | 31 | 3.0 | 2.5 | 0.76 | ◎ | Example |
| 40 | 1002 | 124.1 | 24.1 | 27 | 2.0 | 1.4 | 1.00 | | Example |
| 41 | 894 | 19.4 | 23.1 | 49 | 2.5 | 1.8 | 0.84 | ◎ | Comparative example |
| 42 | 1022 | 9.3 | 9.5 | 15 | 4.5 | 3.8 | 0.98 | Δ | Comparative example |
| 43 | 1013 | 26.1 | 26.2 | 22 | 2.0 | 1.7 | 1.00 | x | Comparative example |
| 44 | 1266 | 11.2 | 12.0 | 33 | 2.5 | 2.1 | 0.93 | ◎ | Comparative example |
| 45 | 999 | 22.9 | 22.9 | 11 | 3.0 | 2.1 | 1.00 | | Comparative example |
| 46 | 1234 | 14.5 | 16.2 | 32 | 3.0 | 2.1 | 0.89 | ◎ | Example |
| 47 | 1285 | 15.0 | 18.0 | 34 | 2.5 | 1.8 | 0.83 | ◎ | Example |
| 48 | 982 | 30.3 | 30.9 | 20 | 3.0 | 1.9 | 0.98 | ◎ | Example |
| 49 | 1213 | 15.8 | 17.1 | 41 | 3.5 | 1.9 | 0.92 | ◎ | Example |
| 50 | 1242 | 16.7 | 18.7 | 48 | 2.0 | 1.3 | 0.89 | ◎ | Example |
| 51 | 1200 | 16.8 | 17.9 | 43 | 2.5 | 1.8 | 0.94 | ◎ | Example |
| 52 | 1093 | 24.5 | 25.9 | 24 | 2.0 | 1.4 | 0.95 | ◎ | Example |
| 53 | 1283 | 15.3 | 16.3 | 50 | 1.5 | 1.1 | 0.94 | ◎ | Example |
| 54 | 1187 | 14.2 | 14.9 | 46 | 3.0 | 2.5 | 0.95 | ◎ | Example |
| 55 | 1034 | 22.4 | 23.1 | 19 | 2.5 | 2.1 | 0.97 | ◎ | Example |
| 56 | 997 | 26.9 | 29.0 | 22 | 3.0 | 2.1 | 0.93 | ◎ | Example |
| 57 | 1184 | 15.0 | 19.4 | 33 | 2.5 | 2.1 | 0.77 | ◎ | Example |
| 58 | 1029 | 22.5 | 27.0 | 30 | 2.5 | 1.8 | 0.83 | ◎ | Example |
| 59 | 996 | 26.7 | 31.2 | 26 | 3.0 | 2.1 | 0.86 | ◎ | Example |
| 60 | 993 | 21.1 | 23.2 | 24 | 2.5 | 1.8 | 0.91 | ◎ | Example |
| 61 | 1245 | 15.3 | 15.5 | 39 | 2.5 | 2.1 | 0.99 | ◎ | Example |
| 62 | 1001 | 23.8 | 23.8 | 22 | 2.5 | 1.6 | 1.00 | | Example |
| 63 | 1213 | 14.7 | 16.7 | 41 | 2.5 | 1.8 | 0.88 | ◎ | Example |
| 64 | 1200 | 15.1 | 18.4 | 42 | 2.5 | 2.1 | 0.82 | ◎ | Example |

Underlined portion: outside the scope of the present invention.

A JIS No. 5 specimen was taken such that the tensile direction was perpendicular to the rolling direction of the steel sheet. A tensile test was performed on the JIS No. 5 specimen in accordance with JIS Z 2241 (2011) to measure the tensile strength (TS), total elongation (EL), and, for a coated steel sheet, ductility after coating (EL/EL'). EL' denotes the total elongation of a sheet fed without immersion in the plating bath. For a cold-rolled steel sheet, EL=EL'. The mechanical properties were judged to be good in the case of:

for TS=980 MPa or more and less than 1180 MPa, EL≥20% and EL/EL'≥0.7 for TS=1180 MPa or more, EL≥12% and EL/EL'≥0.7

The hole expansion formability conformed to JIS Z 2256 (2010). Each steel sheet was cut into 100 mm×100 mm and was then punched to form a hole with a diameter of 10 mm at a clearance of 12%±1%. While the steel sheet was pressed with a die with an inner diameter of 75 mm at a blank holding force of 9 tons, a 60-degree conical punch was pushed into the hole to measure the hole diameter at the crack initiation limit. The limiting hole expansion ratio A (%) was calculated using the following formula, and the hole expansion formability was evaluated from the limiting hole expansion ratio.

$$\text{Limiting hole expansion ratio } \lambda(\%)=\{(D_f-D_0)/D_0\}\times 100$$

$D_f$ denotes the hole diameter (mm) at the time of cracking, and $D_0$ denotes the initial hole diameter (mm). In accordance with aspects of the present invention, for each TS range, the following are judged to be good.

For TS=980 MPa or more and less than 1180 MPa, $\lambda \geq 15\%$

For TS=1180 MPa or more, $\lambda \geq 25\%$

In a bending test, a bending test specimen 30 mm in width and 100 mm in length was taken from each annealed steel sheet such that the rolling direction was the bending direction, and the measurement was performed by a V-block method according to JIS Z 2248 (1996). A test was performed three times at each bend radius at an indentation speed of 100 mm/sec, and the presence or absence of a crack was judged with a stereomicroscope on the outside of the bent portion. The minimum bend radius at which no cracks were generated was defined as the critical bend radius R. In accordance with aspects of the present invention, the bendability of the steel sheet was judged to be good when the critical bending $R/t \leq 2.5$ (t: the thickness of the steel sheet) in 90-degree V bending was satisfied.

The coatability was evaluated by appearance. An appropriate surface quality without a poor appearance, such as a coating defect, uneven alloying, or another defect affecting the surface quality, was judged to be good (circle), in particular, an excellent appearance without an uneven color tone was judged to be excellent (double circle), an appearance with a partial slight defect was judged to be fair (triangle), and an appearance with many surface defects was judged to be poor (cross). The double circle, circle, and triangle were judged to be within the scope according to aspects of the present invention.

The high-strength steel sheets according to the examples have a TS of 980 MPa or more and have excellent formability. In contrast, the comparative examples are inferior in at least one characteristic of TS, EL, ductility after coating, λ, bendability, and coatability.

INDUSTRIAL APPLICABILITY

Aspects of the present invention provide a high-strength steel sheet with a tensile strength (TS) of 980 MPa or more and with excellent formability. A high-strength steel sheet according to aspects of the present invention can improve mileage due to the weight reduction of automobile bodies when used in automobile structural parts, for example, and has significantly high industrial utility value.

The invention claimed is:

1. A high-strength steel sheet comprising:

a chemical composition containing, on a mass percent basis,

C: 0.030% to 0.250%,

Si: 0.01% to 3.00%,

Mn: 2.00% to 8.00%,

P: 0.100% or less,

S: 0.0200% or less,

N: 0.0100% or less,

Al: 0.001% to 2.000%, and a balance being Fe and incidental impurities, and a steel microstructure containing, on an area fraction basis, ferrite: 1% to 40%, fresh martensite: 1% to 20%, bainite and tempered martensite in total: 45% to 90%, and retained austenite: 6% or more, wherein a value obtained by dividing an average Mn content (% by mass) of the retained austenite by an average Mn content (% by mass) of the ferrite is 1.1 or more, and a value obtained by dividing an average C content (% by mass) of retained austenite with an aspect ratio of 2.0 or more by an average C content (% by mass) of the ferrite is 3.0 or more, and a value obtained by dividing a C content of all retained austenite by a C content of a $T_0$ composition is 1.0 or more, wherein the C content of the $T_0$ composition is calculated from the composition of steel sheet and its content using integrated thermodynamic calculation software Thermo-Calc and database TCFE7, and wherein the $T_0$ composition is the composition calculated at a reheating temperature before immersion in a galvanizing bath.

2. The high-strength steel sheet according to claim 1, wherein the chemical composition contains at least one element selected from Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.100% or less, Zr: 0.200% or less, Ca: 0.0050% or less, Mg: 0.0050% or less, and REM: 0.0050% or less, on a mass percent basis.

3. The high-strength steel sheet according to claim 2, wherein the steel microstructure contains massive retained austenite and fresh martensite, wherein massive retained austenite is austenite with an aspect ratio of less than 2.0, and wherein a value obtained by dividing an area fraction of massive retained austenite with an average grain size of 3 μm or less by an area fraction of all retained austenite and fresh martensite is 0.5 or less.

4. The high-strength steel sheet according to claim 3 further comprising a galvanized layer on a surface thereof.

5. The high-strength steel sheet according to claim 4, wherein the galvanized layer is a galvannealed layer.

6. The high-strength steel sheet according to claim 2, further comprising a galvanized layer on a surface thereof.

7. The high-strength steel sheet according to claim 6, wherein the galvanized layer is a galvannealed layer.

8. The high-strength steel sheet according to claim 1, wherein the steel microstructure contains massive retained austenite and fresh martensite, wherein massive retained austenite is austenite with an aspect ratio of less than 2.0, and wherein a value obtained by dividing an area fraction of massive retained austenite with an average grain size of 3 μm or less by an area fraction of all retained austenite and fresh martensite is 0.5 or less.

9. The high-strength steel sheet according to claim 8 further comprising a galvanized layer on a surface thereof.

10. The high-strength steel sheet according to claim 9, wherein the galvanized layer is a galvannealed layer.

11. The high-strength steel sheet according to claim 1, further comprising a galvanized layer on a surface thereof.

12. The high-strength steel sheet according to claim 11, wherein the galvanized layer is a galvannealed layer.

13. The high-strength steel sheet according to claim 1, wherein the chemical composition contains, on a mass percent basis, Mn: 3.28% to 8.00%.

14. A method for manufacturing the high-strength steel sheet according to claim 1, comprising: heating a steel slab with the chemical composition, hot rolling the steel slab at a finish rolling delivery temperature in the range of 750° C. to 1000° C., performing coiling at 300° C. to 750° C., performing cold rolling, holding in a temperature range of not less than $Ac_3$ transformation temperature−50° C. for 20 s to 1800 s, performing cooling to a cooling stop temperature of a martensitic transformation start temperature or lower, reheating to a reheating temperature in the range of 120° C. to 450° C. and holding the reheating temperature for 2 s to 1800 s, performing cooling to room temperature, holding in a temperature range of not less than $Ac_1$ transformation temperature−20° C. for 20 s to 600 s, performing cooling to a cooling stop temperature of the martensitic transformation start temperature or lower, reheating to a reheating temperature in the range of 120° C. to 480° C. and holding the reheating temperature for 2 s to 600 s, and performing cooling to room temperature.

15. The method for manufacturing the high-strength steel sheet according to claim 14, further comprising performing galvanizing treatment.

16. The method for manufacturing the high-strength steel sheet according to claim 15, comprising performing galvannealing at 450° C. to 600° C. after the galvanizing treatment.

17. The method for manufacturing the high-strength steel sheet according to claim 14, comprising holding in the temperature range of the $Ac_1$ transformation temperature or lower for more than 1800 s after the coiling and before the cold rolling.

18. A method for manufacturing the high-strength steel sheet according to claim 2, comprising: heating a steel slab with the chemical composition, hot rolling the steel slab at a finish rolling delivery temperature in the range of 750° C. to 1000° C., performing coiling at 300° C. to 750° C., performing cold rolling, holding in a temperature range of not less than $Ac_3$ transformation temperature−50° C. for 20 s to 1800 s, performing cooling to a cooling stop temperature of a martensitic transformation start temperature or lower, reheating to a reheating temperature in the range of 120° C. to 450° C. and holding the reheating temperature for 2 s to 1800 s, performing cooling to room temperature, holding in a temperature range of not less than $Ac_1$ transformation temperature−20° C. for 20 s to 600 s, performing cooling to a cooling stop temperature of the martensitic transformation start temperature or lower, reheating to a reheating temperature in the range of 120° C. to 480° C. and holding the reheating temperature for 2 s to 600 s, and performing cooling to room temperature.

19. The method for manufacturing the high-strength steel sheet according to claim 18, further comprising performing galvanizing treatment.

20. The method for manufacturing the high-strength steel sheet according to claim 19, comprising performing galvannealing at 450° C. to 600° C. after the galvanizing treatment.

21. The method for manufacturing the high-strength steel sheet according to claim 18, comprising holding in the temperature range of the $Ac_1$ transformation temperature or lower for more than 1800 s after the coiling and before the cold rolling.

* * * * *